US010583662B2

(12) United States Patent
Yamada et al.

(10) Patent No.: US 10,583,662 B2
(45) Date of Patent: Mar. 10, 2020

(54) LIQUID SUPPLY APPARATUS, LIQUID EJECTION HEAD, AND LIQUID SUPPLY METHOD

(71) Applicant: CANON KABUSHIKI KAISHA, Tokyo (JP)

(72) Inventors: Kazuhiro Yamada, Yokohama (JP); Yohei Nakamura, Yokohama (JP); Yoshiyuki Nakagawa, Kawasaki (JP); Naozumi Nabeshima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/139,999

(22) Filed: Sep. 24, 2018

(65) Prior Publication Data

US 2019/0092036 A1 Mar. 28, 2019

(30) Foreign Application Priority Data

Sep. 28, 2017 (JP) ..... 2017-188773
Sep. 13, 2018 (JP) ..... 2018-171902

(51) Int. Cl.

*B41J 2/175* (2006.01)
*B41J 2/14* (2006.01)
*B41J 2/19* (2006.01)
*B41J 2/18* (2006.01)

(52) U.S. Cl.

CPC ..... *B41J 2/17523* (2013.01); *B41J 2/1404* (2013.01); *B41J 2/14024* (2013.01); *B41J 2/14072* (2013.01); *B41J 2/175* (2013.01); *B41J 2/17596* (2013.01); *B41J 2/18* (2013.01); *B41J 2/19* (2013.01); *B41J 2202/12* (2013.01); *B41J 2202/20* (2013.01); *B41J 2202/21* (2013.01)

(58) Field of Classification Search

CPC ..... B41J 2/18; B41J 2202/12
See application file for complete search history.

(56) References Cited

U.S. PATENT DOCUMENTS 9,278,540 B2 3/2016 Seki et al. ..... B41J 2/17513
9,315,041 B2 4/2016 Moriguchi et al. ..... B41J 2/17596
9,327,513 B2 5/2016 Moriguchi et al. ..... B41J 2/175
9,333,758 B2 5/2016 Koshikawa et al. ..... B41J 2/17523
9,358,803 B2 6/2016 Moriguchi et al. ..... B05B 7/24
9,375,938 B2 6/2016 Kondo et al. ..... B41J 2/1752
9,597,884 B2 3/2017 Nanjo et al. ..... B41J 2/17526
9,597,888 B2 3/2017 Takahashi et al. .. B41J 2/17566
9,694,585 B2 7/2017 Shiba et al. ..... B41J 2/17506
(Continued)

FOREIGN PATENT DOCUMENTS

JP 5731657 6/2015

OTHER PUBLICATIONS

U.S. Appl. No. 16/139,972, filed Sep. 24, 2018.

*Primary Examiner* — Julian D Huffman
(74) *Attorney, Agent, or Firm* — Venable LLP

(57) ABSTRACT

Ink is supplied to a print head through a pressure compensation mechanism and a common collection flow path in a case where a predetermined differential pressure or higher between a pressure in a common supply flow path of the print head and a pressure in a common collection flow path of the print head is generated. As a result, liquid refillability for the liquid ejection head is improved while retaining a liquid circulating function in the liquid ejection head so as to stabilize a liquid ejecting state in the liquid ejection head.

12 Claims, 19 Drawing Sheets

(56) References Cited

U.S. PATENT DOCUMENTS

| | | | | |
|---|---|---|---|---|
| 9,724,926 | B2 | 8/2017 | Keefe et al. | B41J 2/17 |
| 9,751,317 | B2 | 9/2017 | Nakamura et al. | B41J 2/17506 |
| 9,821,562 | B2 | 11/2017 | Nanjo et al. | B41J 2/17526 |
| 9,840,082 | B2 | 12/2017 | Nanjo et al. | B41J 2/17526 |
| 9,908,338 | B2 | 3/2018 | Koshikawa et al. | B41J 2/17559 |
| 9,914,308 | B2 | 3/2018 | Yamada et al. | B41J 2/18 |
| 9,925,791 | B2 | 3/2018 | Yamada | B41J 2/17563 |
| 9,975,340 | B2 | 5/2018 | Karita et al. | B41J 2/14112 |
| 9,981,464 | B2 | 5/2018 | Karita et al. | B41J 2/1404 |
| 10,005,287 | B2 | 6/2018 | Yamada et al. | B41J 2/17596 |
| 2007/0291086 | A1* | 12/2007 | Murakami | B41J 2/18 347/85 |
| 2017/0197426 | A1 | 7/2017 | Nagai et al. | B41J 2/14024 |
| 2017/0341404 | A1 | 11/2017 | Nakagawa | B41J 2/17553 |
| 2017/0341406 | A1 | 11/2017 | Yamada et al. | B41J 2/17596 |
| 2018/0015728 | A1 | 1/2018 | Nanjo et al. | B41J 2/17526 |
| 2018/0244039 | A1 | 8/2018 | Karita et al. | B41J 2/1404 |

* cited by examiner

LIQUID SUPPLY APPARATUS, LIQUID EJECTION HEAD, AND LIQUID SUPPLY METHOD

BACKGROUND OF THE INVENTION

Field of the Invention

The present invention relates to a liquid supply apparatus which supplies liquid to a liquid ejection head capable of ejecting liquid such as ink, a liquid supply method, and the liquid ejection head which ejects liquid such as ink.

Description of the Related Art

Japanese Patent No. 5731657 discloses, in a printing apparatus (liquid ejection apparatus) using a print head (liquid ejection head) capable of ejecting ink (liquid) from an ejection port, a configuration of circulating ink within the print head. To be more specific, a decompression-type regulator mechanism controls pressure in a supply flow path that supplies ink to the print head to be a constant supply pressure, and a back-pressure type regulator mechanism controls pressure in a collection flow path that collects ink from the print head to be a constant collection pressure that is lower than the supply pressure. Ink circulation within the print head through the supply flow path and the collection flow path caused by a differential pressure between those supply pressure and collection pressure enables removal of foreign matters such as air bubbles within the print head, thereby improving the reliability of ink ejection.

SUMMARY OF THE INVENTION

In the printing apparatus disclosed in Japanese Patent No. 5731657, refilling the print head with ink is made through the supply flow path. Further, the back-pressure type regulator mechanism included in the collection flow path is configured to block an ink backflow (refilling with ink) from the collection flow path to the print head. For this reason, for instance, at the time of high-duty printing that ejects a large amount of ink to a unit printing area in a short period of time, ink refilling only from the supply flow path is insufficient, and there may be a possibility that the pressure within the print head partially largely varies. To be more specific, the ejection port which repeats ink ejection operation among a plurality of ejection ports in the print head has an increased negative pressure in the downstream side of the ejection ports in an ink circulating direction. Due to the negative pressure, the flow rate of refilled ink passing through the vicinity of other ejection ports which are in an ink non-ejecting state increases such that the negative pressure within the print head partially varies. Such pressure variation within the print head may possibly induce unstable ink ejecting state and may lead to deteriorated quality of a printed image. Such deteriorated quality of a printed image is more prominent as the number of ejection ports in the print head is larger and the number of ejection ports in a non-ejecting state at the time of high-duty printing is larger.

The present invention provides a liquid supply apparatus, a liquid ejection head, and a liquid supply method which can stabilize a liquid ejecting state of the liquid ejection head by improving liquid refillability for the liquid ejection head while retaining liquid circulation function of the liquid ejection head.

In the first aspect of the present invention, there is provided a liquid supply apparatus which supplies liquid to a pressure chamber that holds liquid ejected from an ejection port, the apparatus comprising:

a supply flow path for liquid which communicates with the pressure chamber;

a collection flow path for liquid which communicates with the pressure chamber;

a pressure control unit configured to generate a pressure difference between the supply flow path and the collection flow path so as to supply liquid from the supply flow path to the pressure chamber and to collect liquid from the pressure chamber to the collection flow path; and a pressure compensation unit configured to compensate for reduction of pressure in the collection flow path by supplying liquid to the collection flow path in a case where pressure in the collection flow path is a predetermined pressure or lower.

In the second aspect of the present invention, there is provided a liquid supply method of supplying liquid to a liquid ejection head for ejecting liquid within a pressure chamber from an ejection port, the method comprising the steps of:

pressure-controlling to generate a pressure difference between a supply flow path and a collection flow path so as to supply liquid to the pressure chamber from the supply flow path which communicates with the pressure chamber and to collect liquid within the pressure chamber from the collection flow path which communicates with the pressure chamber; and pressure-compensating to compensate for reduction of pressure within the collection flow path by supplying liquid to the collection flow path in a case where pressure within the collection flow path is a predetermined pressure or lower.

In the third aspect of the present invention, there is provided a liquid ejection head comprising:

a pressure chamber including an energy generating element for ejecting liquid provided therein;

a supply flow path for liquid which communicates with the pressure chamber;

a collection flow path for liquid which communicates with the pressure chamber;

a pressure control unit configured to generate a pressure difference between the supply flow path and the collection flow path so as to supply liquid from the supply flow path to the pressure chamber and to collect liquid from the pressure chamber to the collection flow path; and a pressure compensation unit configured to supply liquid to the collection flow path in a case where pressure in the collection flow path is a predetermined pressure or lower.

According to the present invention, liquid within the liquid ejection head is circulated through a liquid supply flow path and a liquid collection flow path, and the liquid is also supplied from the liquid collection flow path depending on the state of the liquid ejection head. As a result, liquid refillability for the liquid ejection head can be improved, thereby stabilizing the ejecting state of the liquid ejection head.

Further features of the present invention will become apparent from the following description of exemplary embodiments with reference to the attached drawings.

DESCRIPTION OF THE EMBODIMENTS

With reference to the drawings, explanations will be given below on embodiments of the present invention. The following embodiments are examples of applications as an inkjet printing apparatus (liquid ejection apparatus) which prints an image by ejecting ink, as liquid, from an inkjet print head as a liquid ejection head.

First Embodiment

1. Schematic Configuration of Printing Apparatus

Figure 1A:
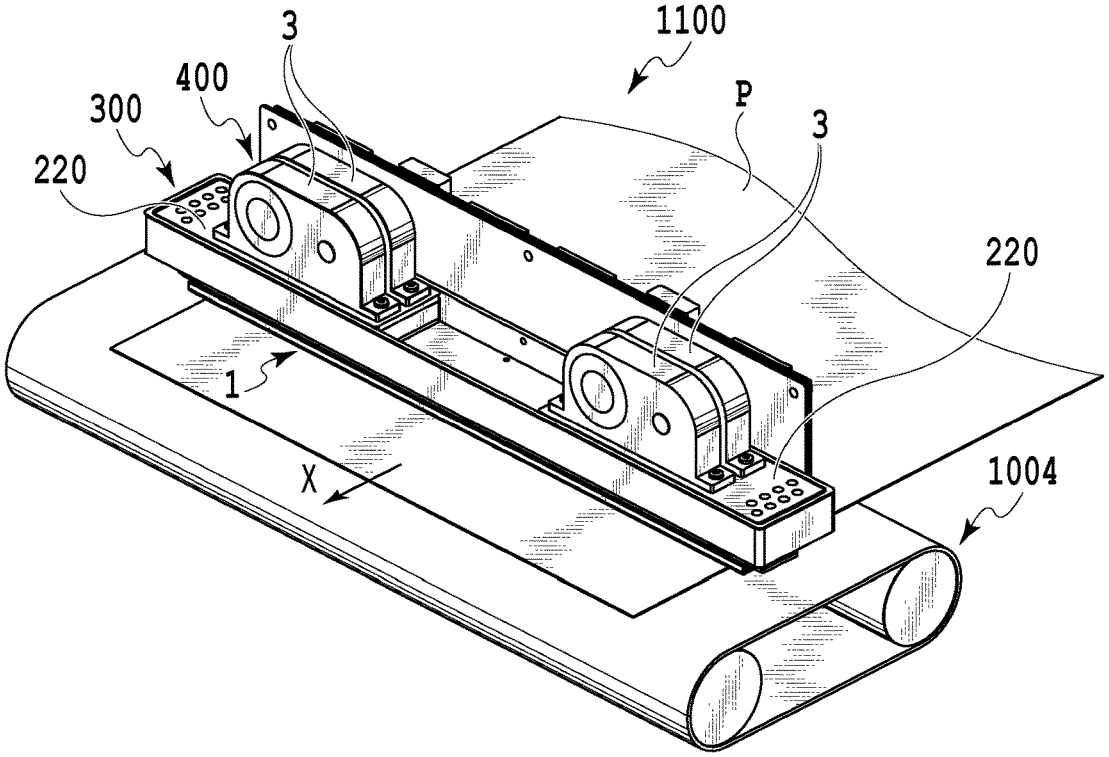
FIGS. 1A and 1B are a schematic configuration diagram of an entire printing apparatus according to a first embodiment of the present invention.

FIG. 1A is a schematic perspective view of an inkjet printing apparatus (liquid ejection apparatus) 1100 according to the present embodiment. The printing apparatus 1100 includes a conveyance unit 1004 which conveys a print medium P in an arrow X direction, an ink ejection unit (liquid ejection unit) 300 including an inkjet print head (liquid ejection head) 1, and an ink circulation unit (liquid circulation unit) 400. The structure of the conveyance unit 1004 may be, besides a system using a conveyance belt as illustrated in this example, any systems such as a system of using, for example, conveyance rollers. The ink ejection unit 300 includes the inkjet print head (liquid ejection head) 1 of a line type which extends in a direction intersecting (in the case of this example, orthogonal to) a conveyance direction of the print medium P (arrow X direction). The print head 1 has a plurality of ejection ports formed thereon, and those ejection ports are arranged so as to form ejection port arrays that extend in a direction intersecting (in the case of this example, orthogonal to) the conveyance direction of the print medium P. The print head 1 includes an ejection energy generation element such as an electrothermal transducing element (heater) or a piezoelectric element for ejecting ink from the ejection port. In the case of including the electrothermal transducing element, ink is bubbled by the heat generation, and the resultant ink can be ejected from the ejection port by using such bubble generating energy.

The printing apparatus 1100 of this example is a printing apparatus of a so-called full-line type, and as a plurality of print media P are continuously conveyed by the conveyance unit 1004, ink is ejected from the ejection port of the print head 1 to continuously print images on the print media P. The printing apparatus 1100 may also be a printing apparatus of a so-called serial scanning type which prints images along with reciprocal movement of the print head 1 in a direction intersecting the conveyance direction of the print medium P and intermittent conveying operation of the print medium P by the conveyance unit 1004. The print medium P is not limited to a cut sheet, but may be a continuous roll paper. The print head 1 can print a full-color image by ejecting inks of cyan (C), magenta (M), yellow (Y), and black (K). As will be described later, ink is supplied to the print head 1 and is circulated within the print head 1. In addition, to the print head 1, an electric control unit for transmitting power and ink ejection control signals is electrically connected.

Figure 1B:
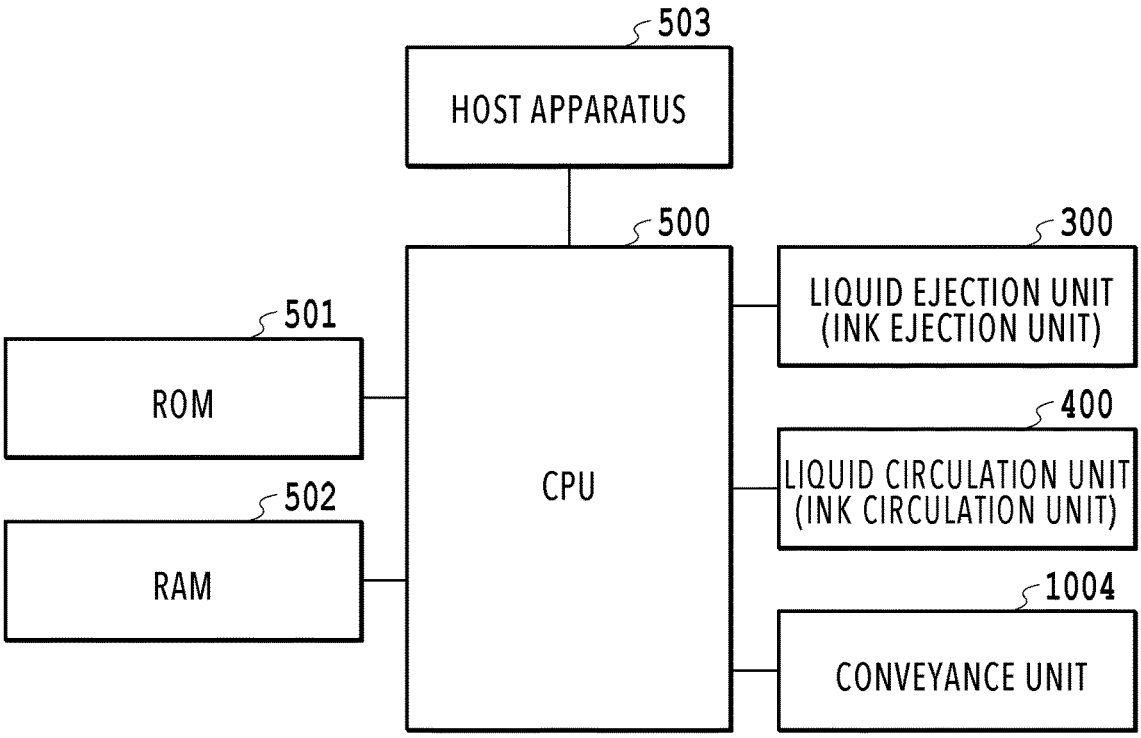

FIG. 1B is a block diagram of a control system of the printing apparatus 1100. A CPU (control unit) 500 executes control processing, data processing, and the like on the operation of the entire printing apparatus 1100 including the ink ejection unit 300, the ink circulation unit 400, and the conveyance unit 1004. In a ROM 501, programs of those processing procedures and the like are stored. A RAM 502 is used as a work area for executing such processing. The CPU 500 causes the print head 1 of the ink ejection unit 300 to eject ink to print an image on the print medium P based on image data inputted from an external host apparatus 503, for example.

2. Ink Flow Path

Figure 2A:
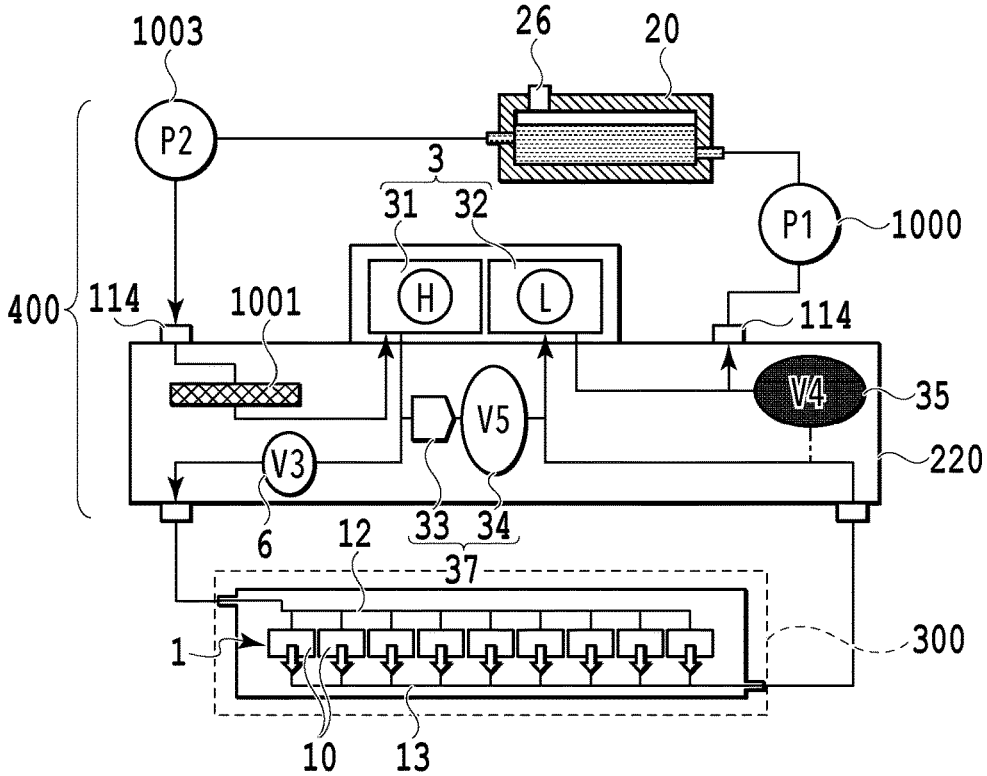
FIGS. 2A and 2B are diagrams illustrating an ink flow path in different states in the printing apparatus of FIG. 1A.

FIG. 2A is a diagram illustrating an ink flow path adapted to one color of ink in the printing apparatus 1100. The printing apparatus 1100 in the figure is in a print operation standby state (non-printing state).

A tank 20 which is replaceable includes an atmosphere communication hole 26. Ink contained in the tank is supplied through a pressurizing pump 1003 and a filter 1001. Further, the tank 20 is connected to a suction pump 1000 for collecting ink.

Ink supplied from the tank 20 is once pressurized by the pressurizing pump 1003, passes through the filter 1001, and is adjusted to a predetermined negative pressure by a first pressure control mechanism (first pressure control section) 31 of a negative pressure control unit (pressure control unit) 3. Then, the ink passes through a supply valve 6 and is supplied to a common supply flow path 12 formed on the print head 1. Subsequently, the ink passes through a later-described flow path formed within a print element substrate 10 and enters a second pressure adjustment mechanism (second pressure control section) 32 of a negative pressure control unit 3 from a common collection flow path 13, and then returns to the tank 20 suctioned by the suction pump 1000. In the print operation standby state, a passive valve 33, an opening/closing valve 34, and a bypass valve 35 are closed. These functions will be described later.

The first pressure control mechanism (H) 31 and the second pressure control mechanism (L) 32 in the negative pressure control unit 3 are the so-called decompression-type regulator mechanism and back-pressure type regulator mechanism, respectively. These control mechanisms 31, 32 can, as will be described later, stabilize ink pressure in the downstream side of the control mechanism 31 and the upstream side of the control mechanism 32 within a certain range even in a case where an ink-passing flow rate fluctuates due to the functioning of valves and spring members inside the respective mechanisms. The control pressure of the second pressure control mechanism 32 is set to be lower than the control pressure of the first pressure control mechanism 31. Accordingly, inside the print head 1, there is generated an ink flow (flow shown with an outlined arrow direction in FIG. 2A) that passes from the common supply flow path 12 through the inside of the print element substrate (hereinafter also referred to as an "element substrate") 10 towards the common collection flow path 13. Due to such an ink flow, an ink flow is generated in each of the element substrates 10 in the non-printing state, and foreign matters such as bubbles and thickened ink can be discharged to the tank 20. Therefore, operation of ejecting (preliminary ejection) ink that does not contribute to the printing of an image from the ejection ports is unrequired for discharging those foreign matters from the ejection ports of the print head 1, thereby enhancing reliability of ejection operation of the print head 1.

An ink flow rate passing inside the element substrates 10 can be set within a range in which the discharge of such foreign matters can be achieved. On the other hand, in a typical print head, the flow path in the vicinity of the ejection port is an extremely fine microchannel having a width of several tens of μm or less, and thus ink pressure loss passing inside the element substrates 10 is extremely high. Accordingly, in a case where the ink flow rate within the element substrates 10 is too high, there may be a possibility that the negative pressure in the vicinity of the ejection port becomes too high and thus ink meniscus suitable for ink ejection operation can no longer be retained. It is preferable that, in the case of the element substrates 10 having the ejection ports arranged in a high dense so that the interval between the ejection ports becomes 600 dpi or more, the ink flow rate be set lower than the ink ejection rate at the time of full ejection of ink (when ink is ejected simultaneously from all the ejection ports).

3. Compensation Function of Negative Pressure Fluctuation

Figure 2B:
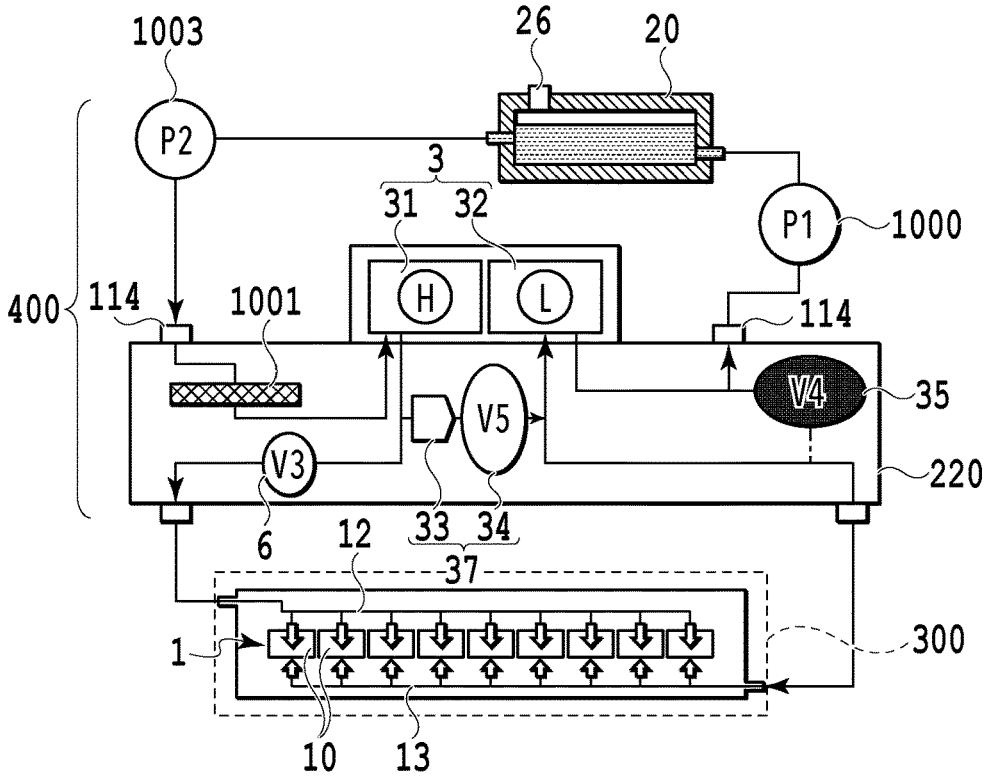

FIG. 2B is a diagram illustrating an ink flow in a high-duty printing state in which a large amount of ink is ejected in a short period of time on a unit print area and in the state in which an ink ejection rate from the ejection ports of all the element substrates 10 is high.

As described above, in terms of preventing excessive negative pressure generation in the vicinity of the ejection port, it is preferable that an ink flow rate passing through the element substrates 10 during the non-print operation be set smaller than the ejection rate at the time of full ejection of ink. However, in the case of such setting at the time of high-duty printing, as shown with outlined arrows in FIG. 2B, with respect to the ejection ports, not only an ink-refilling flow from the common supply flow path 12 but also an ink-refilling flow from the common collection flow path 13 are generated.

As will be described later, even in such a case, the second pressure control mechanism (back-pressure type regulator) 32 is configured such that an ink backflow does not occur. Further, the suction pump 1000 is configured such that an ink backflow does not occur as well. Accordingly, in the case where high-duty printing is continued by all print element substrates, there is a possibility that pressure within the collection flow path between the tank 20 and the common collection flow path 13 gradually decreases and the lack of ink refilling eventually occurs with respect to the ejection port. In this case, the volume of ink droplet to be ejected from the ejection port becomes smaller than an initial value at design time, thereby causing reduction in image printing density and occurrence of image blurring. Meanwhile, in a case where part of the element substrates 10 is in a non-printing state or is in a low-duty printing state which ejects a small amount of ink in a short period of time on the unit print area, there may be a possibility that an ink-passing flow rate in the vicinity of the ejection port for the part of the element substrates 10 increases. In this case, negative pressure in the vicinity of the ejection port in the part of the element substrates 10 increases and the abnormal decrease of temperature arises, thereby causing deterioration of the quality in a printed image.

Accordingly, in the present invention, between the downstream side of the first pressure control mechanism 31 in an ink supplying direction and the upstream side of the second pressure control mechanism 32 in an ink collecting direction, a negative pressure compensation mechanism (pressure compensation unit) 37 is connected. The negative pressure compensation mechanism includes the passive valve 33 and the opening/closing valve 34 disposed at a communication path between the supply flow path provided between the first pressure control mechanism 31 and the common supply flow path 12 and the collection flow path provided between the second pressure control mechanism 32 and the common collection flow path 13. In a case where the pressure in the common collection flow path 13 is a predetermined pressure or less, the passive valve 33 opens so as to introduce ink within the supply flow path into the collection flow path. The passive valve 33 of this example operates by a differential pressure between a predetermined pressure within the supply flow path controlled by the first pressure control mechanism 31 and a pressure within the collection flow path. To be more specific, the passive valve 33 is designed to be opened in a case where a differential pressure greater than a differential pressure between the control pressure (high pressure) of the first pressure control mechanism 31 and the control pressure (low pressure) of the second pressure control mechanism 32 arises between those supply flow path and collection flow path. As the opening/closing valve 34 which is controlled to be open and closed is open during the print operation and in the case where the pressure in the common collection flow path 13 is below the control pressure of the second pressure control mechanism 32, the passive valve 33 opens so as to form a communication path between the supply flow path and the collection flow path, and the excessive rise of negative pressure in the vicinity of the ejection port can be suppressed. Therefore, even at the time of high-duty printing, ink can be stably ejected from the ejection ports in each of the element substrates 10.

Figure 3A:
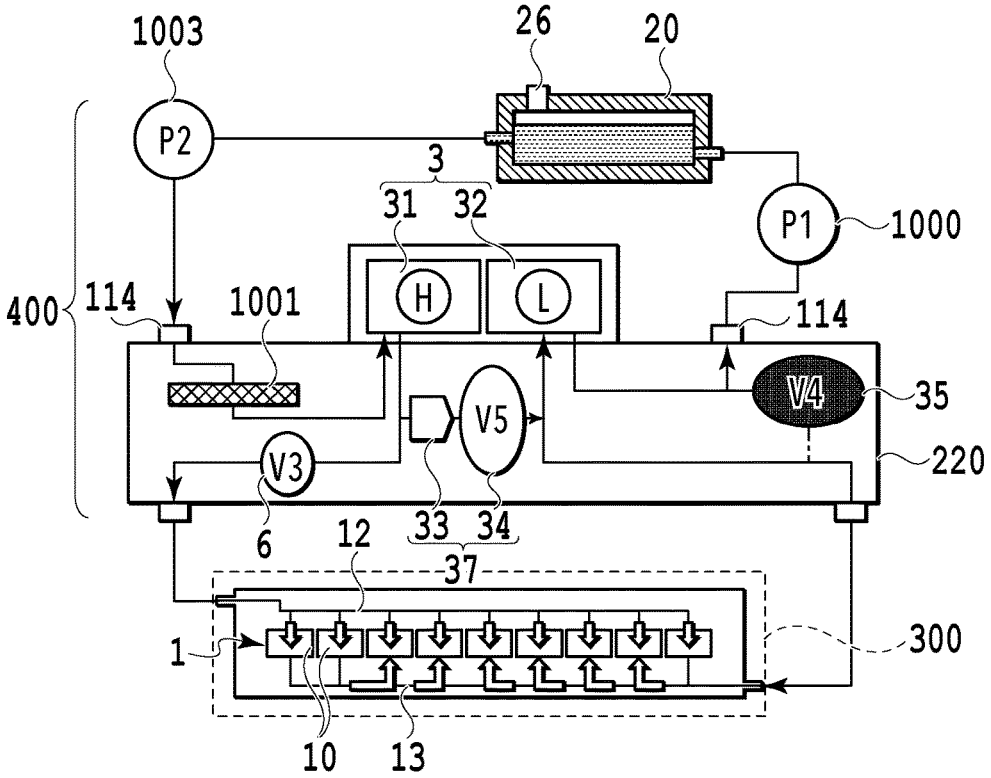
FIGS. 3A and 3B are diagrams illustrating the ink flow path in different states in the printing apparatus of FIG. 1A.

FIG. 3A is a diagram illustrating an ink flow in a case where most part of element substrates 10 are in a high-duty printing state and few part of element substrates 10 are in the print operation standby state. With respect to the element substrates 10 in the high-duty printing state, an ink-refilling flow (flow in an outlined upward arrow direction in FIG. 3A)

from the common collection flow path 13 is generated. Meanwhile, ink that has passed within the element substrates 10 in the standby state is appropriated to such an ink-refilling flow. However, in the case where the flow rate of the former ink-refilling flow is higher than an ink flow rate passing through the element substrates 10 in the latter standby state, negative pressure within the common collection flow path 13 increases. In this case, as in the case of FIG. 2B, as the passive valve 33 opens to suppress pressure reduction within the common collection flow path 13, ink of a lacking amount can be supplied through the passive valve 33 and the opening/closing valve 34.

As such, according to the present invention, irrespective of the state of the printing (printing duty), ink can be stably ejected from the ejection ports on each of the element substrates 10.

If the negative pressure compensation mechanism 37 is not provided, an ink flow rate that passes through the element substrates 10 in the standby state increases so as to compensate for the lacking portion of the ink-refilling flow. Accordingly, the ink flow rate passing through the vicinity of the ejection ports of the print element substrates in the standby state may unintentionally change depending on the printing state (printing duty) of the other print element substrate. As in FIG. 3A, in a case where only the several element substrates 10 are in the standby state, the increase of negative pressure and abnormal reduction of temperature occur in the vicinity of the ejection ports of the element substrates 10 in the standby state. As a result, the volume of ink droplet to be ejected from the ejection port is changed from an initial value at design time, thereby causing occurrence of density unevenness on a printed image.

4. Enhanced Recovery Mode

Figure 3B:
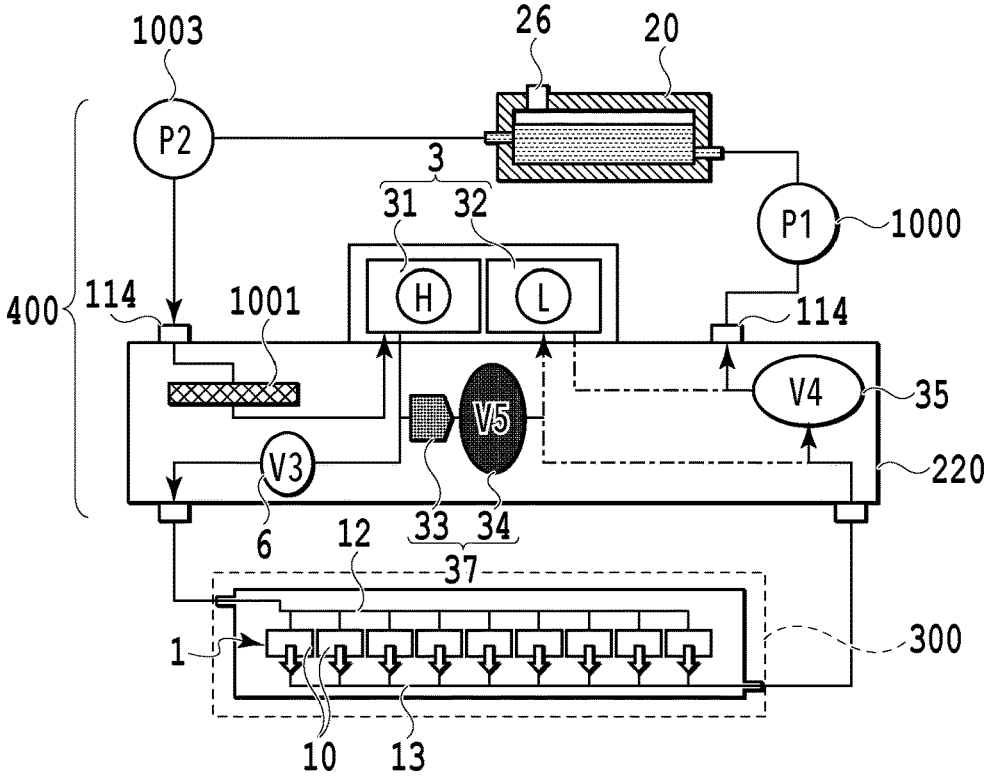

FIG. 3B is a diagram illustrating a bypass flow path connecting the upstream side and downstream side of the second pressure control mechanism 32 and the function of the bypass valve 35 which is controlled to be open and closed included in the bypass flow path.

In the enhanced recovery mode, the bypass valve 35 is controlled to be open so as to make an ink flow rate passing through the print head 1 higher than usual in accordance with the number of rotations of the suction pump 1000 irrespective of the state of operation for the second pressure control mechanism 32. Therefore, in such an enhanced recovery mode, foreign matters (such as bubbles and thickened ink) in the vicinity of the ejection ports and within the common collection flow path 13 which could not have been discharged by ink of a normal flow rate can be discharged. Ink flow rate in the enhanced recovery mode can be selected by considering recoverability to discharge foreign matters within a range in which ink meniscus is retainable in the ejection port. Since this enhanced recovery mode is executed in a non-print operation state, the ink flow rate may be a flow rate in which the negative pressure in the vicinity of the ejection port is an appropriate negative pressure or higher, which is necessary to ensure ink ejection property.

This enhanced recovery mode, which differs from recovery operation (suction recovery and pressurization recovery) for discharging foreign matters contained in ink from the ejection port, can discharge foreign matters within the ejection port and the common collection flow path 13 while significantly reducing waste ink. As such, the reduction of waste ink and simplified mechanism (recovery mechanism) for recovery processing can be achieved. In addition, in the case of executing this enhanced recovery mode, it is required to control the opening/closing valve 34 to be closed. This is because that, in the enhanced recovery mode, a higher differential pressure than usual is generated between the common supply flow path 12 and the common collection flow path 13, whereby the differential pressure cannot be increased by the working of the passive valve 33 unless the function of the negative pressure compensation mechanism 37 is stopped by the opening/closing valve 34. The function of the opening/closing valve 34 may be served by the passive valve 33 itself. Further, it is preferable that the opening/closing valve 34 be closed even at the time at which the printing apparatus is powered off.

5. Configuration of Print Head

Figure 4A:
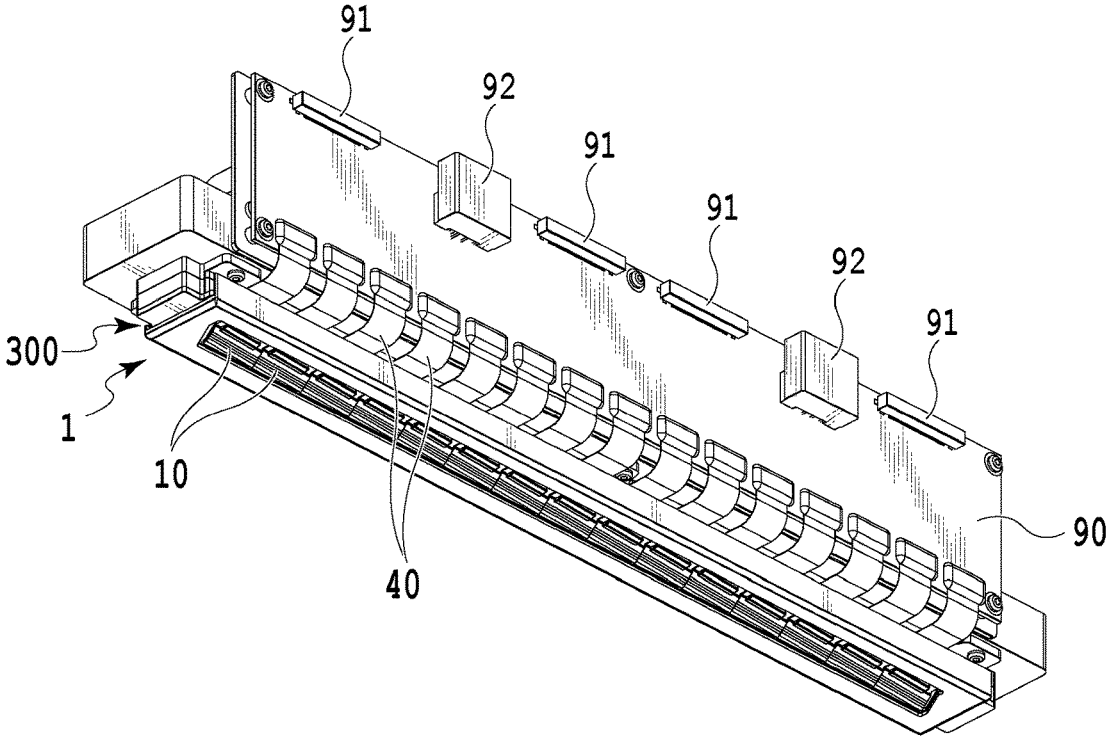
FIGS. 4A and 4B are perspective views of a unit including the print head of FIG. 1A.
Figure 4B:
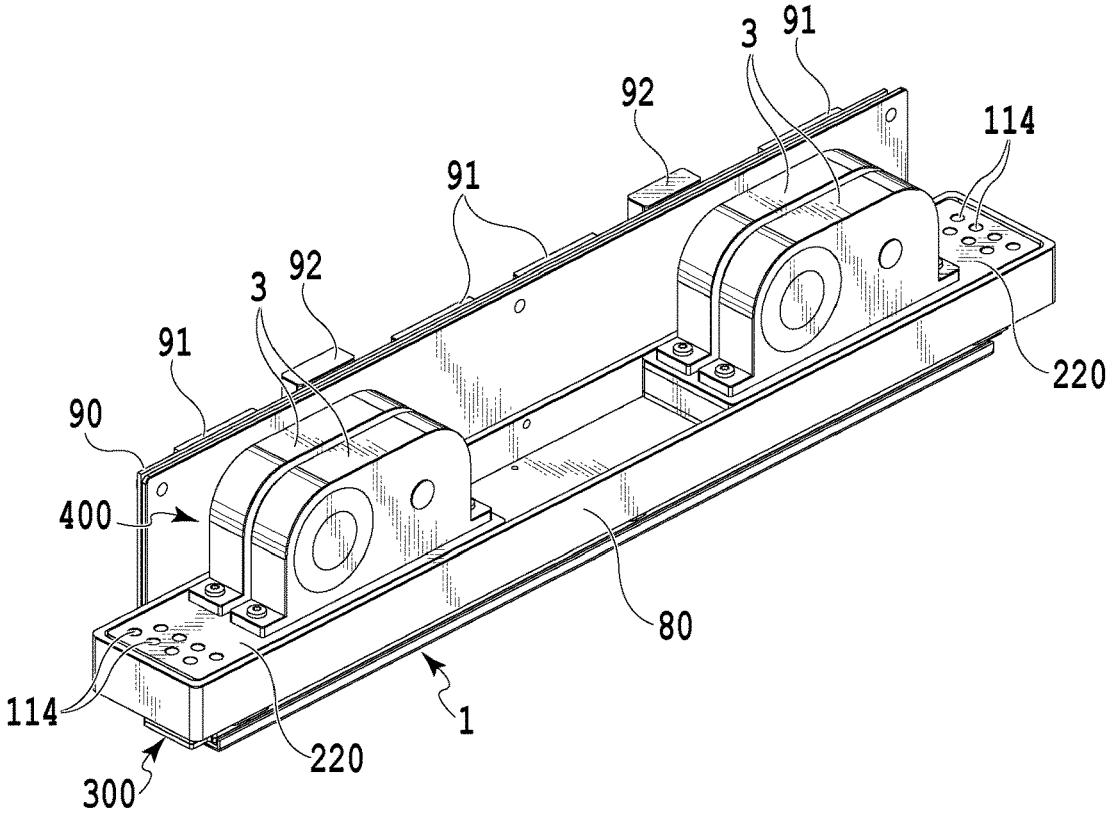

FIG. 4A and FIG. 4B are perspective views of the print head 1 according to the present embodiment.

The print head 1 of this example is a line-type print head in which 15 element substrates 10 are linearly arrayed (in-line arrangement). For each of the element substrates 10, the ejection ports which can eject four colors of ink, that is, C, M, Y, and K, are arranged. The element substrates 10 are electrically connected with signal input terminals 91 and power supply terminals 92 via flexible wiring substrates 40 and an electric wiring substrate 90. The signal input terminals 91 and the power supply terminals 92 are electrically connected to a control unit of the printing apparatus 1100, and, via those signal input terminals 91 and the power supply terminals 92, ejection drive signals and power required for ink ejection are supplied to the element substrates 10. By gathering electric circuit wirings within the electric wiring substrate 90, the number of signal input terminals 91 and power supply terminals 92 may be set to be smaller than the number of element substrates 10. Accordingly, in the case of assembling the print head 1 to the printing apparatus 1100 or in the case of replacing the print head 1 with another, the number of electrical connection units that need to be removed can be suppressed.

The liquid ejection head 1 of the present embodiment has, as shown in FIG. 4B, a configuration including the ink ejection unit 300 and the ink supply unit 220. As such, integrally providing the ink supply unit 220 on the liquid ejection head 1 is preferable in downsizing the printing apparatus 1100. However, the present invention is not limited to such a configuration, and may have a configuration of providing the ink supply unit 220 on the printing apparatus side.

As shown in FIG. 4B, connecting parts 114 located at both ends of the print head 1 are connected to an ink supply system of the printing apparatus 1100 including the tank 20, the pressurizing pump 1003, and the suction pump 1000. Accordingly, as described above, four colors of ink, that is, C, M, Y, and K are supplied to the print head 1 from the ink supply system of the printing apparatus 1100, and the ink having passed inside the print head 1 is collected into the ink supply system of the printing apparatus 1100. As such, each color of ink can be circulated through the ink flow path of the printing apparatus 1100 and the ink flow path of the print head 1.

Figure 5:
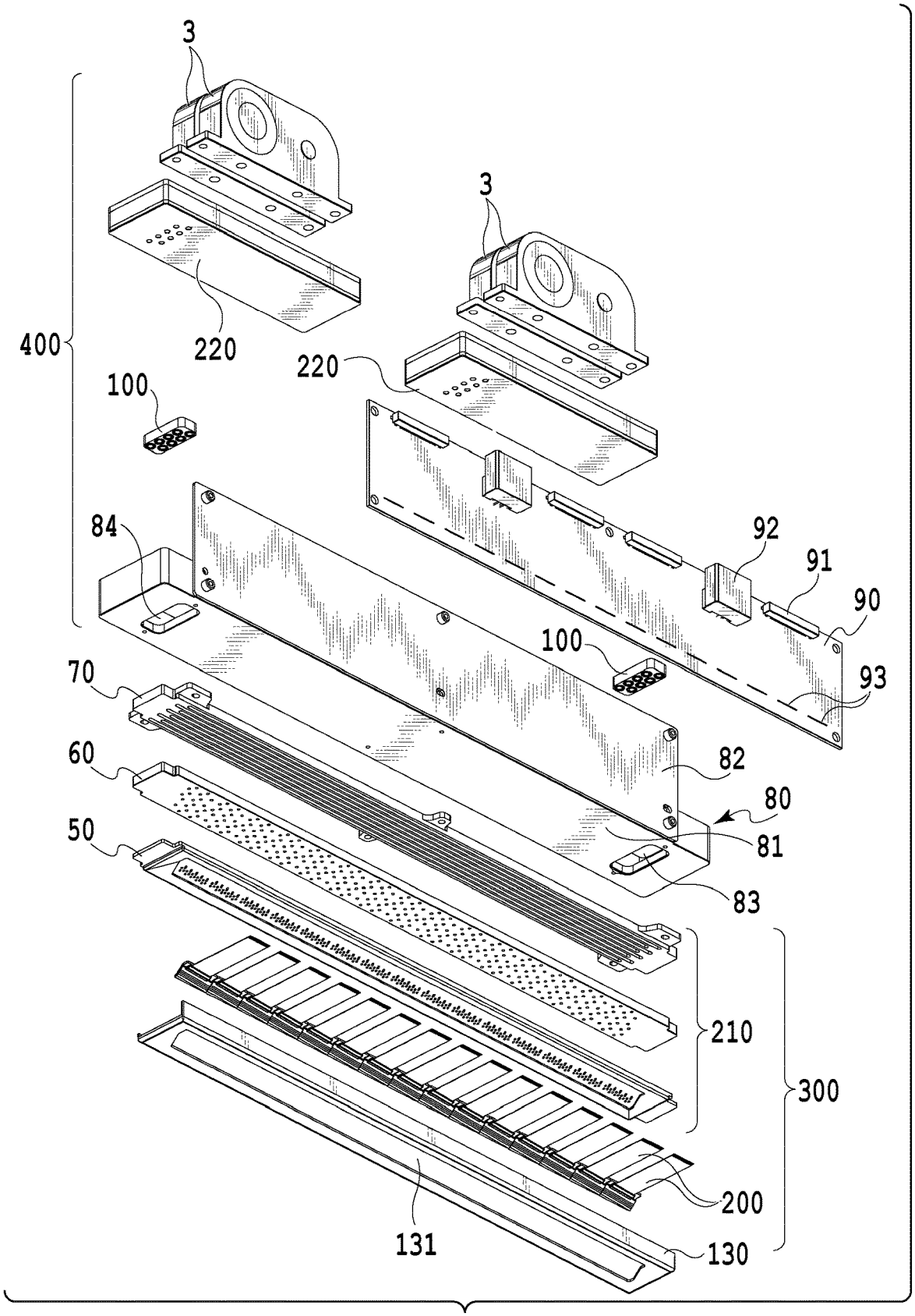
FIG. 5 is an exploded perspective view of the unit including the print head of FIG. 1A.

FIG. 5 is an exploded perspective view of the ink ejection unit 300 including the print head 1, the ink supply unit 220, and the ink circulation unit 400.

The ink ejection unit 300, the ink supply unit 220, and the electric wiring substrate 90 are attached to a casing 80. On the ink supply unit 220, the connecting parts 114 (see FIG. 4B) are provided. Inside the ink supply unit 220, the filter 1001 (see FIG. 2) for every color of ink communicating with apertures of the connecting parts 114 is provided for removing foreign matters contained in the ink to be supplied. Each of the two ink supply units 220 includes the filters 1001 for two colors of ink. Ink passing through the filter 1001 is supplied to the negative pressure control unit 3 which is disposed on the ink supply unit 220 that is adapted to each ink color. Four negative pressure control units 3 in total are disposed so as to be adapted to the respective ink colors. Inside each of the negative pressure control units 3, as in FIG. 2A, the first pressure control mechanism (H) 31 and the second pressure control mechanism (L) 32 are included. These control mechanisms 31, 32 function to significantly attenuate, as will be described later, due to the effect of valves and spring members provided inside those mechanisms, the change of pressure drop within the ink supply system of the printing apparatus 1100 which is generated along with the fluctuation of the ink flow rate. Accordingly, the negative pressure change within the flow path of the ink ejection unit 300 can be stabilized within a certain range.

The casing 80 supports the ink ejection unit 300 by a support part 81 and supports the electric wiring substrate 90 by a support part 82 as well as retains the rigidity of the entire print head 1. The support part 82 that supports the electric wiring substrate 90 is fixed to the support part 81 that supports the ink ejection unit 300 with screws. The support part 81 corrects warping and deformation of the ink ejection unit 300 and ensures the relative position accuracy for a plurality of element substrates 10 so that a streak defect and occurrence of density unevenness in a printed image are suppressed. Therefore, it is preferable that the support part 81 have sufficient rigidity, and as its material, for example, metal material such as SUS or aluminum or ceramics such as alumina are suitable. In the support part 81, apertures 83, 84 for inserting joint rubbers 100 are provided. Ink supplied from the ink supply unit 220 is derived to a third flow path member 70 constituting the ink ejection unit 300 through holes in the joint rubber 100.

The ink ejection unit 300 includes a plurality of ejection modules 200 and flow path members 210. Onto a face of the print medium side of the ink ejection unit 300, a cover member 130 is attached. The cover member 130 is a frame-shaped member in which an elongate opening 131 is provided. Further, from the aperture 131, element substrates 10 and sealing materials 110 (see FIG. 9A) included in the ejection modules 200 are exposed. A frame part around the aperture 131 in the cover member 130 functions as an abutting surface on which a cap member for capping the print head 1 at the time of print standby abuts. It is preferable that an adhesive agent, a sealing material, a filling material, or the like be applied along the surroundings of the aperture 131 to fill in the unevenness and gap on a surface of the ink ejection unit 300 on which the ejection ports are formed. Due to this, a closed space can be formed inside the cap member upon capping with the cap member.

The flow path members 210 have layers of a first flow path member 50, a second flow path member 60, and the third flow path member 70. Due to the flow path members 210, ink supplied from the ink supply unit 220 is distributed to the ejection modules 200 and ink from the ejection modules 200 returns to the ink supply unit 220. The flow path members 210 are fixed to the support part 81 of the casing 80 with screws, and as a result, warping and deformation of the flow path members 210 are suppressed.

Figure 6:
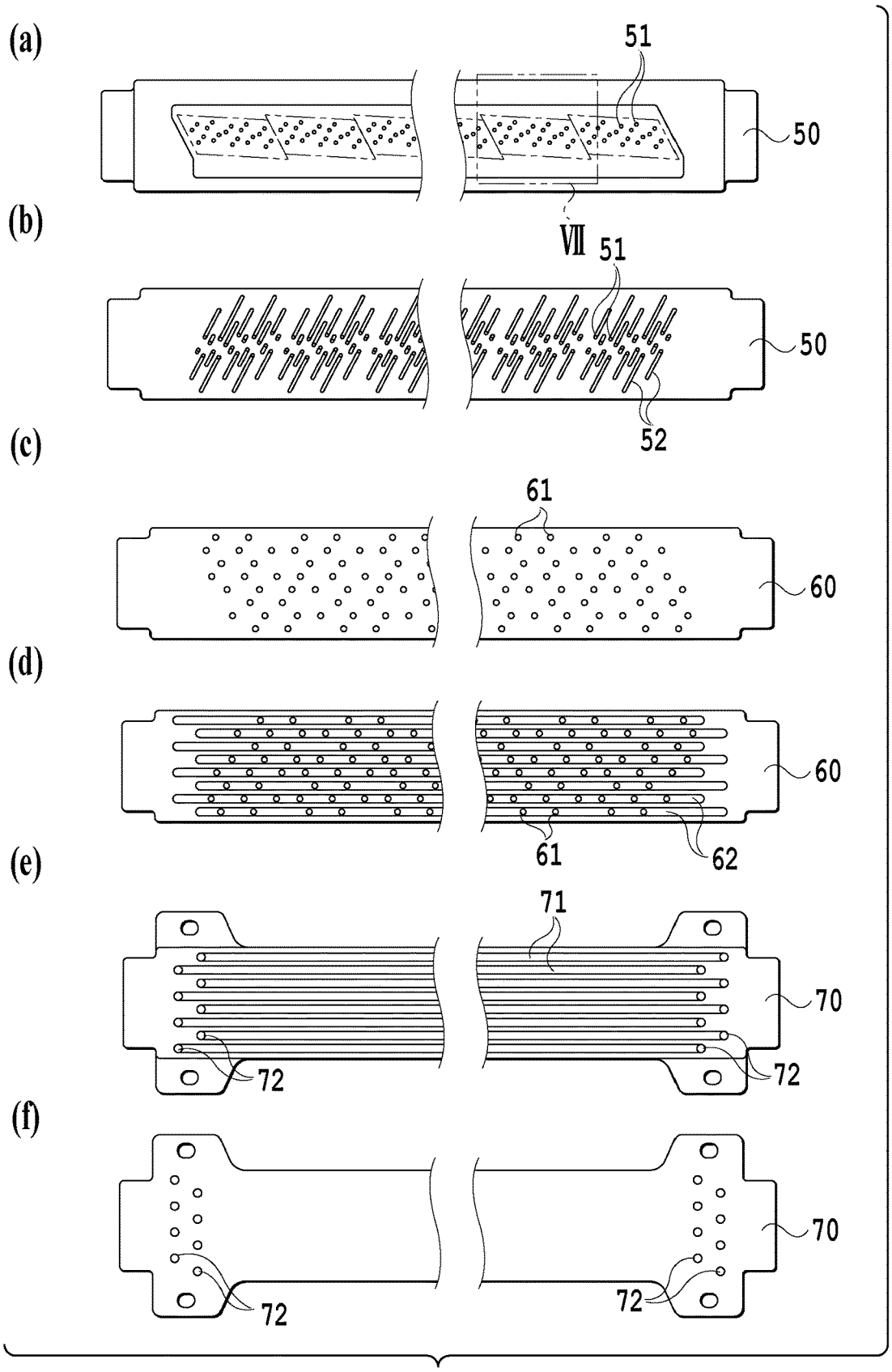
FIG. 6 is a diagram illustrating flow path members constituting the ink ejection unit of FIG. 5, which includes parts (a) to (f)

In FIG. 6, parts (a) and (b) are a front face figure and a rear face figure of the first flow path member 50, respectively; parts (c) and (d) are a front face figure and a rear face figure of the second flow path member 60, respectively; and parts (e) and (f) are a front face figure and a rear face figure of the third flow path member 70, respectively. The part (a) shows the face of the first flow path member 50 on which the ejection modules 200 are mounted. The part (f) shows the face of the third flow path member 70 on which the support part 81 of the casing 80 abuts. The first flow path member 50 and the second flow path member 60 are adjoined such that the face of the part (b) and the face of the part (c) face each other, and the second flow path member and the third flow path member are adjoined such that the face of the part (d) and the face of the part (e) face each other.

By adjoining the second flow path member 60 and the third flow path member 70, common flow path grooves 62, 71 on these joint faces form eight common flow paths in total extending in a longitudinal direction of the flow path members 60, 70. Accordingly, inside the flow path members 210, the common supply flow path 12 and the common collection flow path 13 are each formed for each color of ink. Communication ports 72 on the third flow path member 70 fluidically communicate with the ink supply units 220 through the corresponding holes on the joint rubbers 100. In the second flow path member 60, a plurality of communication ports 61 are formed at the bottom face of the common flow path groove 62, and those communication ports 61 each communicates with one end of an individual flow path groove 52 formed on the first flow path member 50. To the other end of the individual flow path groove 52, a communication port 51 is formed. Through these communication ports 51, the individual flow path grooves 52 fluidically communicate with a plurality of ejection modules 200. Due to these individual flow path grooves 52, flow paths can be intensively formed at a position on the center portion of the flow path members 50, 60, and 70.

It is preferable that the first, second, and third flow path members 50, 60, and 70 be made of materials having corrosion resistance against ink and having low linear expansivity. As those materials, a composite material (resin material) in which inorganic filler (such as particulates and fibers) of silica or alumina is added to a base material such as alumina, LCP (liquid crystalline polymer), PPS (polyphenyl sulfide), or PSF (polysulphone) can be used. As a method of forming the flow path members 210, the three flow path members 50, 60, and 70 may be stacked in layers and bonded to one another, and in a case where a composite resin material is selected as those members' materials, a bonding method by welding may be employed.

Figure 7:
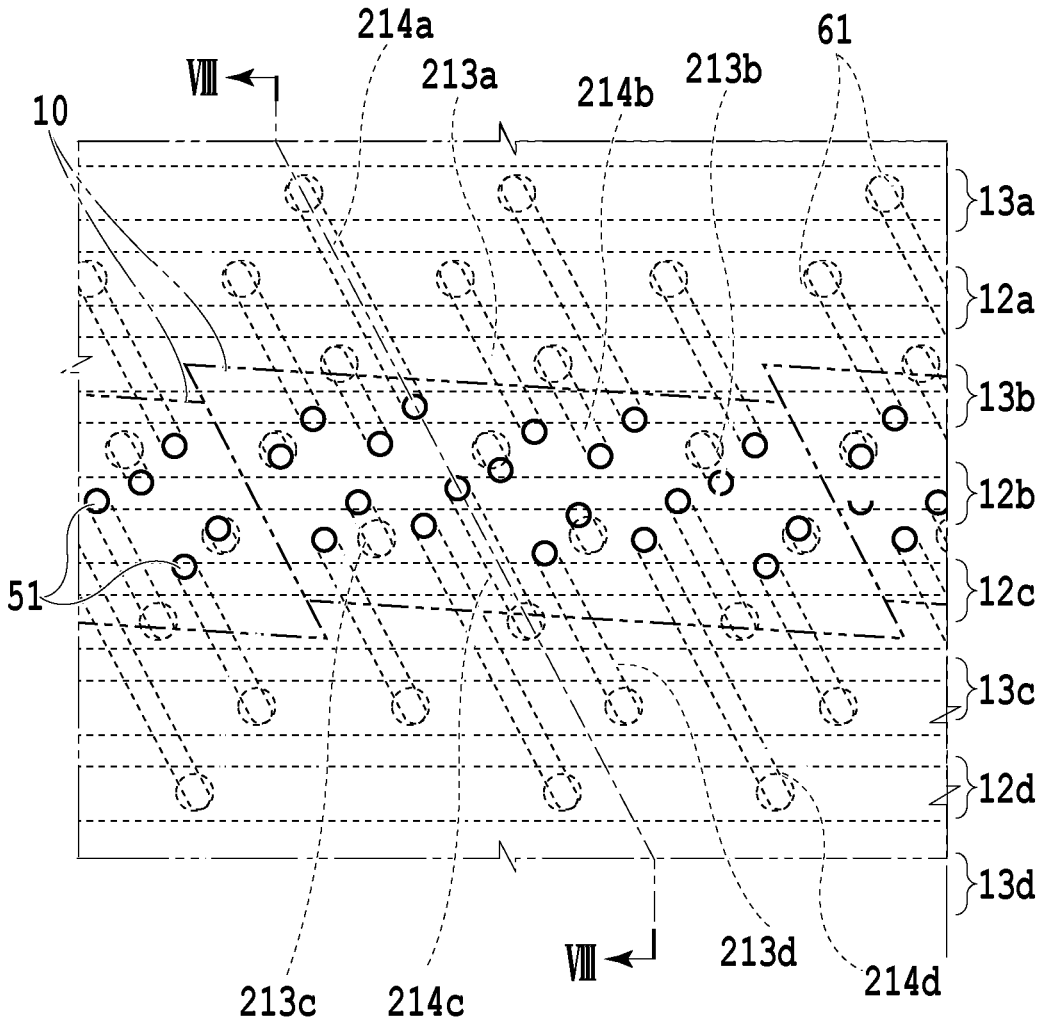
FIG. 7 is an enlarged diagram of VII part in the part (a) of FIG. 6.

FIG. 7 is a diagram perspectively viewing, from the face of the first flow path member 50 in the part (a) of FIG. 6, the flow paths within the flow path members 210 which are formed by joining the first, second, and third flow path members 50, 60, and 70, and the diagram corresponds to an enlarged diagram of VII part in the part (a) of FIG. 6.

On the flow path members 210, common supply flow paths 12 (12*a*, 12*b*, 12*c*, 12*d*) and the common collection flow paths 13 (13*a*, 13*b*, 13*c*, 13*d*) which extend in a longitudinal direction of the print head 1 are formed for respective ink colors. On the common supply flow paths 12 (12*a*, 12*b*, 12*c*, 12*d*), a plurality of first individual flow paths (213*a*, 213*b*, 213*c*, 213*d*) which are formed by the individual flow path grooves 52 are connected via the communication ports 61. To the common collection flow paths 13 (13*a*, 13*b*, 13*c*, 13*d*), a plurality of second individual flow paths (214*a*, 214*b*, 214*c*, 214*d*) which are formed by the individual flow path grooves 52 are connected via the communication ports 61. Due to such a flow path configuration, through the common supply flow paths 12 and the first individual flow paths 213, ink can be intensively supplied to the element substrates 10 located at the center portion of the flow path members 210. Further, through the second individual flow paths 214, ink can be collected from the element substrates 10 into the common collection flow paths 13.

Figure 8:
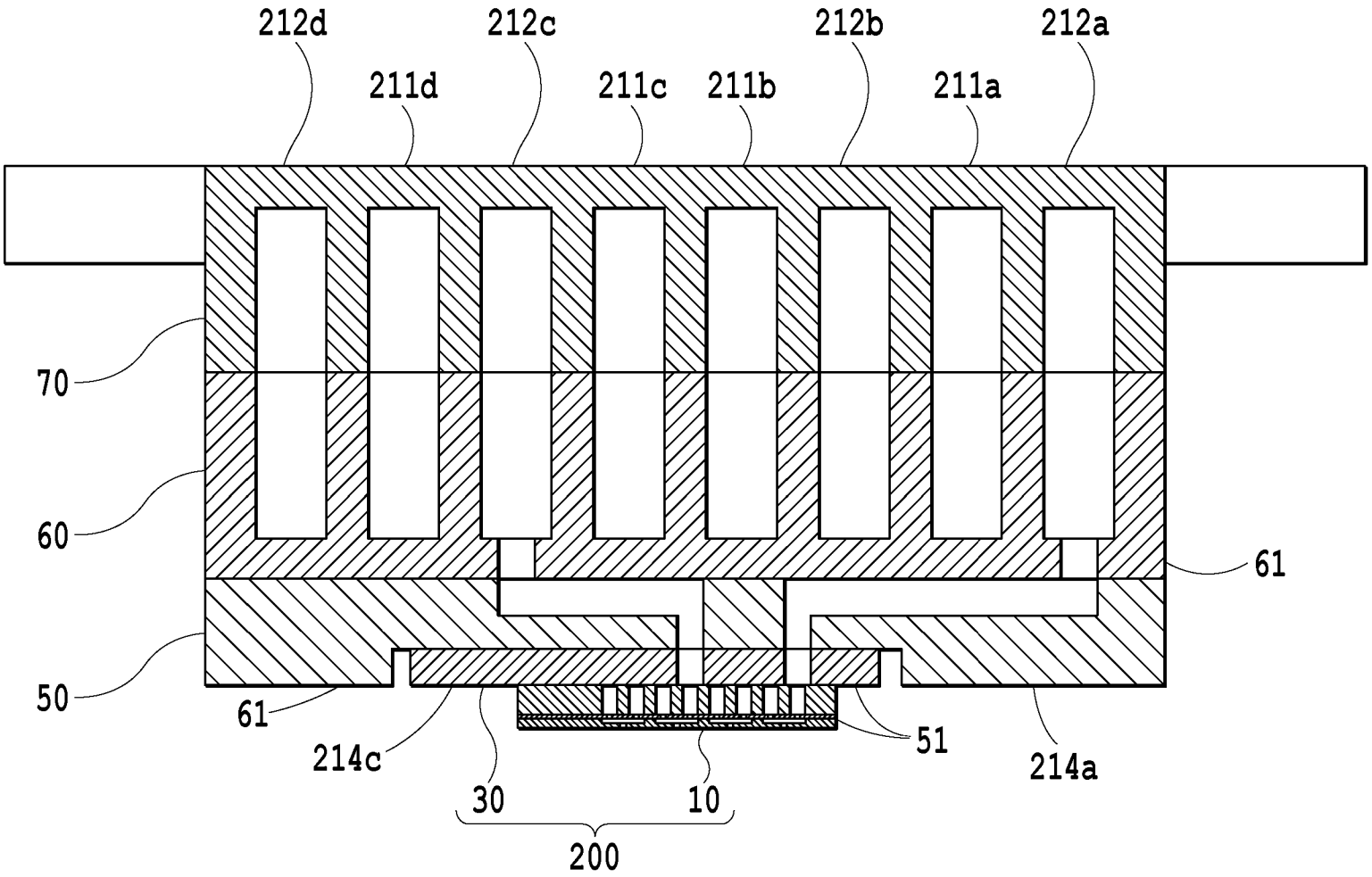
FIG. 8 is a cross sectional view taken along line VIII-VIII of FIG. 7.

FIG. 8 is a cross sectional view taken along line VIII-VIII of FIG. 7.

In FIG. 8, the second individual flow paths 214*a*, 214*c* communicate with the ejection modules 200 through the communication ports 51. The same applies to the other second individual flow paths 214*b*, 214*d*. Further, as in FIG. 7, the first individual flow paths 213 also communicate with the ejection modules 200 through the communication ports 51. On a support member 30 and the element substrates 10 included in the ejection modules 200, supply flow paths for supplying ink from the first flow path member 50 to a pressure chamber 123 (see FIG. 11) of the element substrates 10 are formed. Moreover, in the support member 30 and the element substrates 10, collection flow paths for collecting (circulating) a part of or whole part of ink inside the pressure chamber into the first flow path member 50 are formed.

The common supply flow path 12 for each ink color is connected to the first pressure control mechanism (H) 31 of a high pressure side in a corresponding negative pressure control unit 3 via the ink supply unit 220. Further, the common collection flow path 13 for each ink color is connected to the second pressure control mechanism (L) 32 of a low pressure side in a corresponding negative pressure control unit 3 through the ink supply unit 220. This negative pressure control unit 3 generates, as described above, a differential pressure (difference in pressures) between the common supply flow path 12 and the common collection flow path 13. Due to this, ink flow is generated inside the print head 1, as the ink flowing in the order of the common supply flow path 12, the first individual flow path 213, the element substrate 10, the second individual flow path 214, and the common collection flow path 13.

6. Ejection Module

Figure 9A:
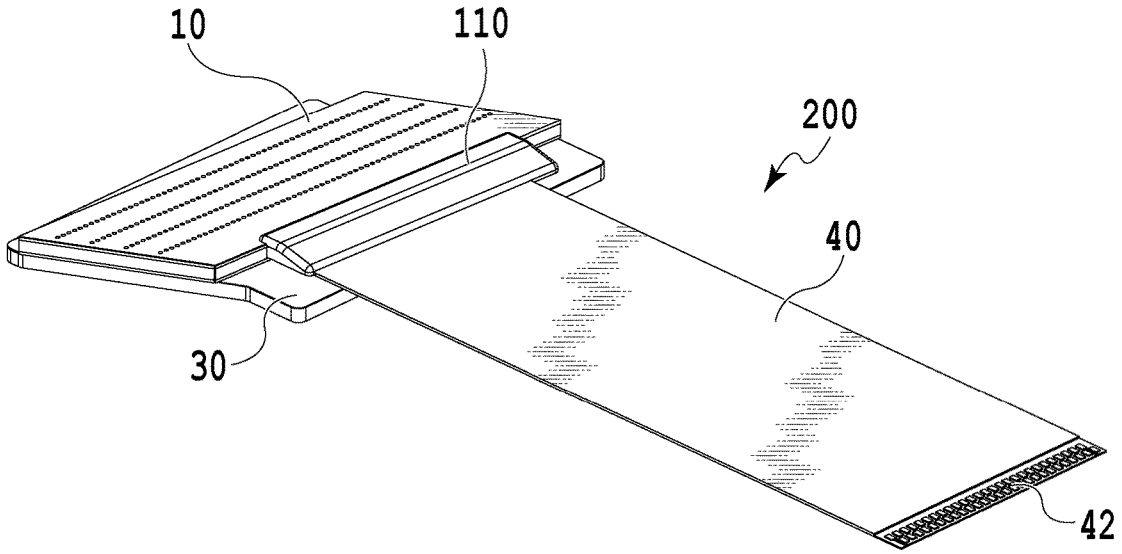
FIGS. 9A and 9B are perspective views of an ejection module in FIG. 5.
Figure 9B:
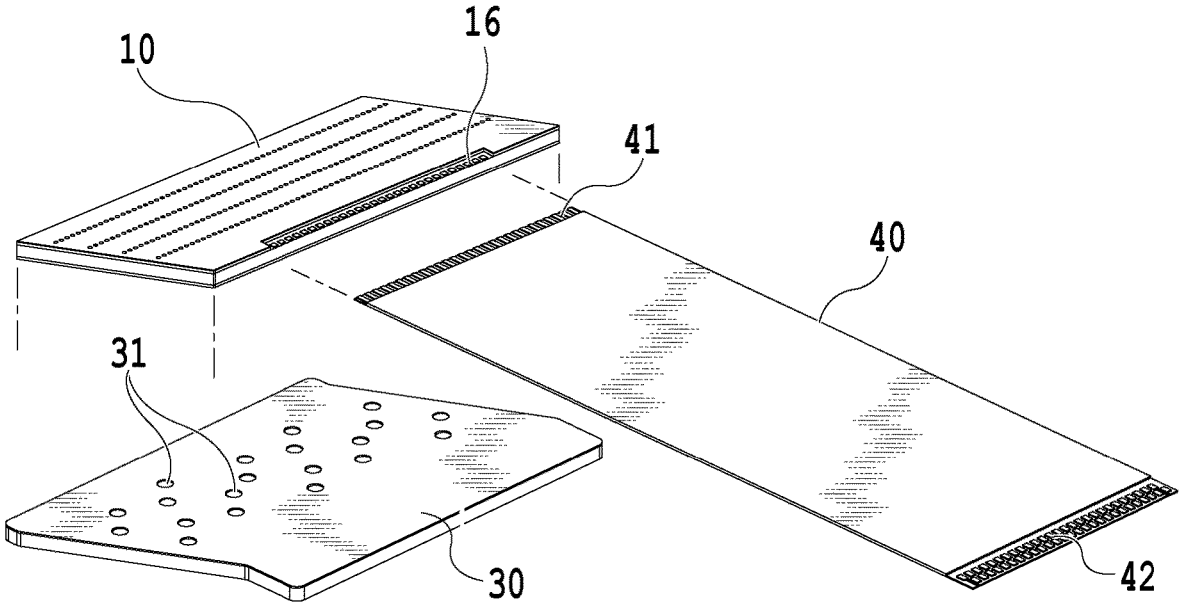

FIG. 9A is a perspective view of one ejection module 200, and FIG. 9B is an exploded perspective view of the ejection module 200.

In the case of manufacturing the ejection modules 200, first of all, the element substrates 10 and the flexible wiring substrates 40 are bonded on the support member 30 in which communication ports 31 are provided in advance. Then, a terminal 16 located on the element substrate 10 and a terminal 41 located on the flexible wiring substrate 40 are electrically connected via wire bonding, and then a wire bonding part (electrically connected part) is sealed by covering it with a sealing material 110. On the flexible wiring substrate 40, a terminal 42 is provided at a position opposite of the connected part with the element substrate 10. Further, the terminal 42 is electrically connected with a connection terminal 93 (see FIG. 5) of the electric wiring substrate 90. The support member 30 is a support body that supports the element substrate 10 and simultaneously is a flow path member that makes the element substrate 10 and the flow path member 210 in a fluidical communication. For this reason, it is preferable that the support member 30 be joined to the element substrate 10 with high flatness and with sufficiently high reliability, and that alumina or resin material, for example, be used as a material of the member.

7. Print Element Substrate (Element Substrate)

Figure 10A:
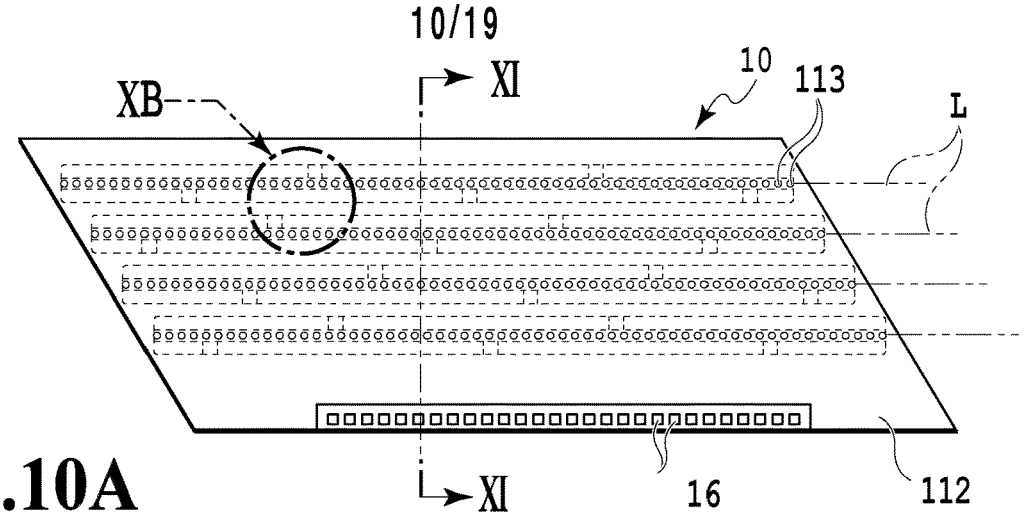
FIGS. 10A, 10B, and 10C are diagrams each illustrating an element substrate in FIG. 9A.
Figure 10B:
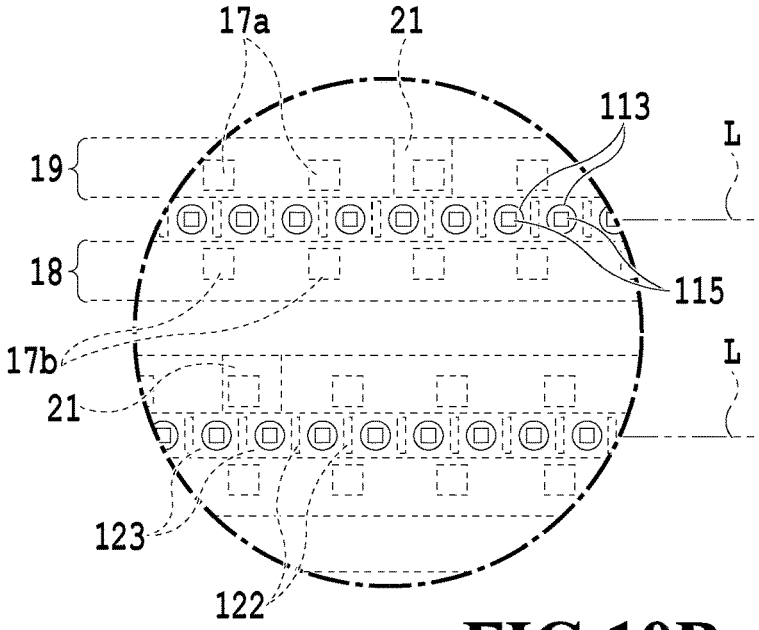
Figure 10C:
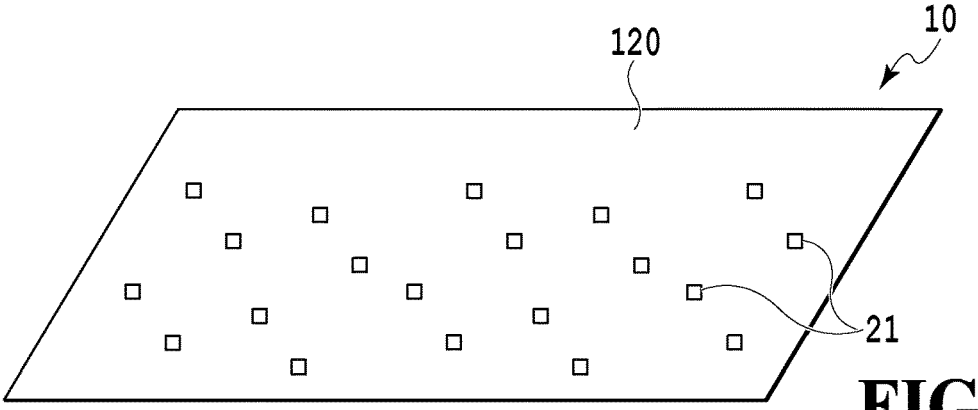

FIG. 10A is a plan view viewing the element substrate 10 from a formation face side of the ejection port 113. FIG. 10B is an enlarged view of a circle XB of FIG. 10A. FIG. 10C is a plan view viewing the element substrate 10 from the opposite side of FIG. 10A. As shown in FIG. 10A, a plurality of ejection ports 113 are formed on an ejection port forming member 112 of the element substrate 10, and these ejection ports 113 are arranged so as to form the total of four arrays of ejection port arrays L that corresponds to respective ink colors. Hereinafter, a direction in which the ejection port arrays L extend is also called an "ejection port array direction."

As shown in FIG. 10B, at positions corresponding to the ejection ports 113, electrothermal transducing elements (heaters) 115 are arranged as an ink ejection energy generation element. The pressure chambers 123 equipped with the heaters 115 are sectioned by partitions 122. The heaters 115 are electrically connected with the terminals 16 of FIG. 10A by non-illustrated electric wiring formed in the element substrates 10. The heater 115 generates heat based on a pulse signal inputted from a control circuit of the printing apparatus 1100 via the electric wiring substrate 90 (see FIG. 5) and the flexible wiring substrate 40 (see FIG. 9A). As a result of such heat generation, ink within the pressure chamber 123 generates bubbles and its bubble generating energy is used to eject ink from the ejection port 113. On one side of the ejection port array L, a supply path 18 extending along the ejection port array L is formed. On the other side of the ejection port array L, a collection path 19 extending along the ejection port array L is formed. The supply path 18 and collection path 19 communicate with the pressure chamber 123 via supply ports 17*a* and collection ports 17*b*, respectively.

As in FIG. 10C, in the element substrate 10, a cover member 120 of a sheet type is stacked on a face opposite of the face on which the ejection ports 113 are formed. On the cover member 120, a plurality of openings 21 communicating with the supply path 18 and the collection path 19 are formed. In this example, three openings 21 are formed for one supply path 18, and two openings 21 are formed for one collection path 19. Those openings 21, as in FIG. 7, communicate with the communication ports 51 of the first flow path member 50 in the part (a) of FIG. 6. The cover member 120 functions, as in FIG. 11, as a cover that forms a part of the walls of the supply path 18 and collection path 19 which are formed in a substrate 111. The cover member 120 preferably has sufficient corrosion resistance against ink, and, from a viewpoint of prevention of ink color mixing, high accuracy is required for an opening shape and opening position of the opening 21. The cover member 120 is preferably configured to be thin in terms of pressure loss as a pitch of flow paths for ink is changed depending on the openings 21. As for the cover member 120, a photosensitive resin material or a silicon sheet, for example, may preferably be used, and openings 21 may preferably be formed by a photolithography process.

Figure 11:
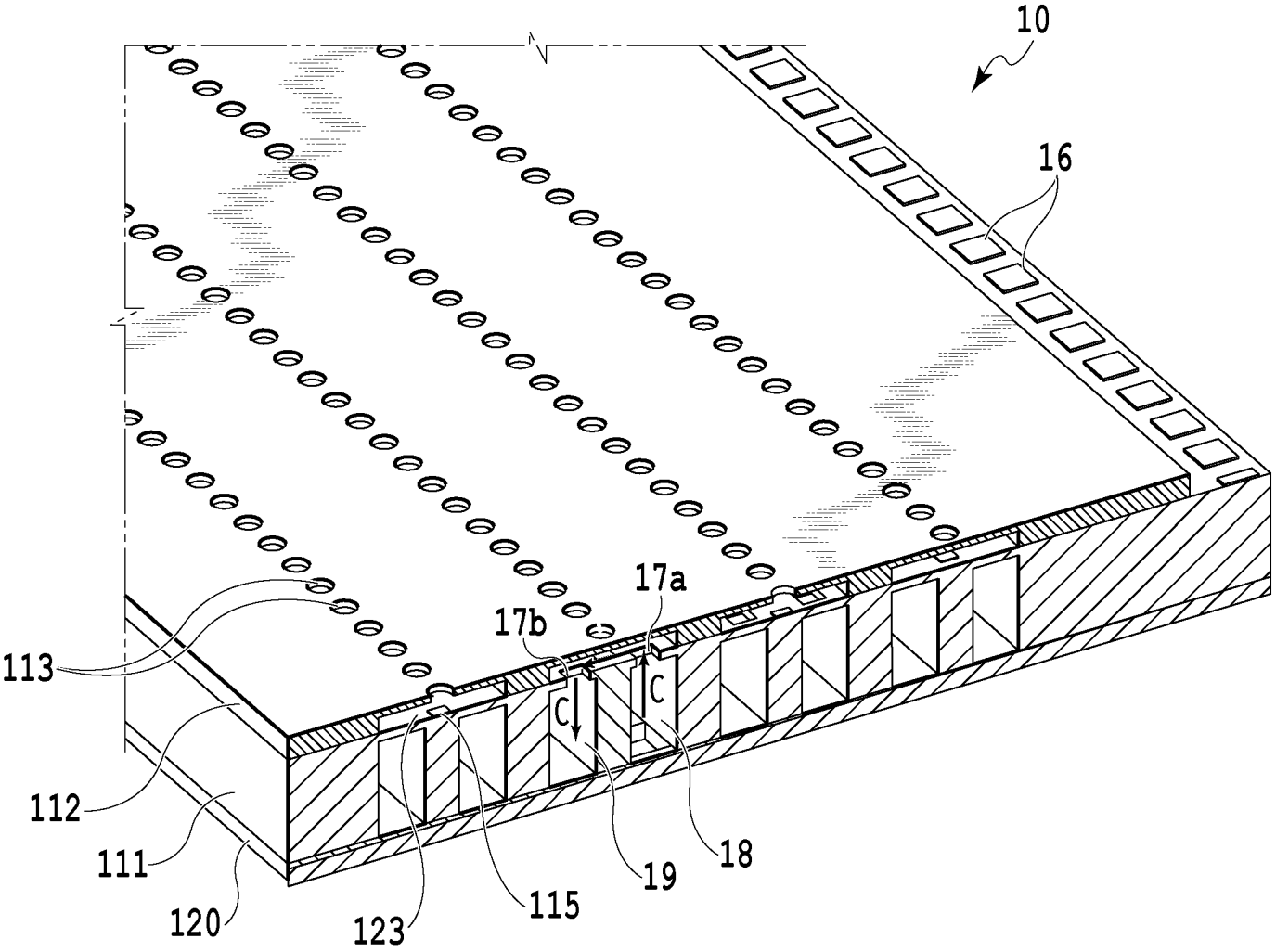
FIG. 11 is a cross sectional view taken along line XI-XI of FIG. 10A.

FIG. 11 is a perspective view of a cross section of the element substrate 10 taken along line XI-XI of FIG. 10A.

In the element substrate 10, the substrate 111 made of Si and the ejection port forming member 112 made of photosensitive resin are stacked, and further, to the rear face of the substrate 111, the cover member 120 is joined. At the front face side (upper side of FIG. 11) of the substrate 111, the heaters 115 are formed. At the rear face side (lower side of FIG. 11) of the substrate 111, grooves for forming the supply path 18 and the collection path 19 extending along the ejection port arrays L are provided. The supply path 18 and the collection path 19 each formed with the substrate 111 and the cover member 120 are connected to the common supply flow path 12 and the common collection flow path 13 within the flow path members 210, and a differential pressure arises between the supply path 18 and the collection path 19. In a case of printing an image by ejecting ink from a plurality of ejection ports 113 of the print head 1, in a non-ink-ejecting port (inactive ejection port) 113, an ink flow is generated by a differential pressure between the supply path 18 and the collection path 19. In other words, ink within the supply path 18 in the substrate 111, as shown by arrows C in FIG. 11, flows to the collection path 19 via the supply port 17*a*, the pressure chamber 123, and the collection port 17*b*. In the inactive ejection port 113 and its corresponding pressure chamber 123, foreign matters such as bubbles and thickened ink generated by evaporation of ink component from the inactive ink ejection port 113 can be collected by this ink flow through the collection path 19. In addition, ink viscosity in the ejection port 113 and the pressure chamber 123 can be suppressed.

Ink collected into the collection path 19 passes the opening 21 of the cover member 120, the communication port 31 of the support member 30, the communication port 51 of the flow path members 210, the individual collection flow path 214, and the common collection flow path 13, and is finally collected into the tank 20.

In other words, ink is supplied and collected from the printing apparatus body to the print head 1 as follows.

First of all, ink supplied from the printing apparatus body flows into the print head 1 from the connecting part 114 of the ink supply unit 220, and then, by passing through the first pressure control mechanism 31 within the negative pressure control unit 3, the ink is adjusted to a relatively low negative pressure. The pressure-adjusted ink flows in the order of the ink supply unit 220, the joint rubber 100, the communication port 72 and the common flow path groove 71 of the third flow path member 70, the common flow path groove 62 and the communication port 61 of the second flow path member 60, the individual flow path groove 52 and the communication port 51 of the first flow path member 50. Subsequently, ink within the communication port 51 passes through the communication port 31 of the support member 30, the opening 21 of the cover member 120, and the supply path 18 and the supply port 17*a* of the substrate 111 to be supplied within the pressure chamber 123. Out of ink supplied to the pressure chamber 123, ink that is not ejected from the ejection port 113 flows through the collection port 17*b* and the collection path 19 of the substrate 111, the opening 21 of the cover member 120, and the communication port 31 of the support member 30. Then, the ink passes through the communication port 51 and the individual flow path groove 52 of the first flow path member 50, the communication port 61 and the common flow path groove 62 of the second flow path member 60, the common flow path groove 71 and the communication port 72 of the third flow path member 70, the joint rubber 100, and the ink supply unit 220. Then, the ink flows into the ink supply unit 220 again from the second pressure control mechanism 32 within the negative pressure control unit 3, and subsequently, is collected into the tank 20 outside the print head 1 through the connecting part 114.

8. Positional Relation Between Print Element Substrates (Element Substrates)

Figure 12:
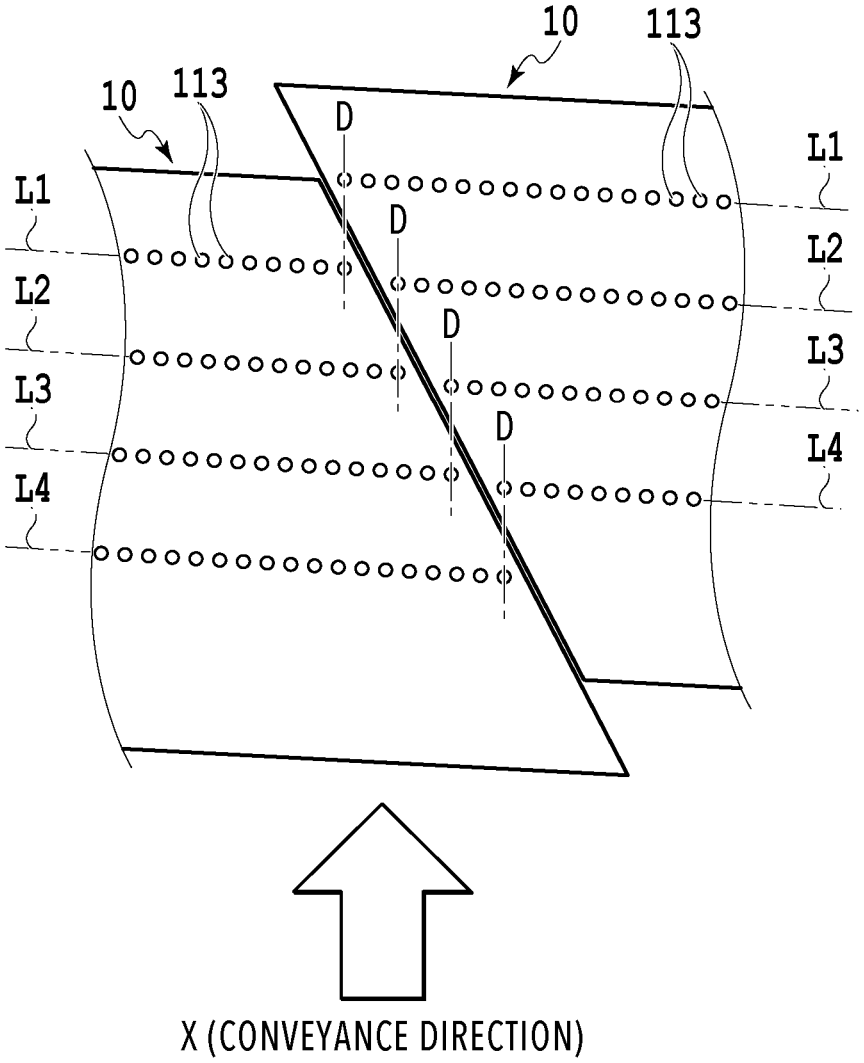
FIG. 12 is an enlarged view of adjacent parts of the element substrate in FIG. 10A.

FIG. 12 is an enlarged plane view of adjacent parts of the element substrates 10 in the two adjacent ejection modules 200. In this example, as in FIG. 10A, the element substrate 10 having a shape of almost parallelogram for its plane face is employed. As in FIG. 12, the ejection port arrays L (L1, L2, L3, and L4) on which the ejection ports 113 are arranged in the element substrate 10 are formed so as to be inclined at a certain angle with respect to a conveyance direction (arrow X direction) of the print medium P. Due to this, the ejection port arrays L in the adjacent part of the element substrates 10 are arranged such that at least one ejection port 113 overlaps in the conveyance direction of the print medium P. In the example of FIG. 12, two ejection ports 113 on a line D along the arrow X direction overlap with each other.

By relevantly drive-controlling the heaters 115 corresponding to mutually overlapping ejection ports 113 in such a positional relation, even if the position of arranging the element substrate 10 is somewhat deviated from a predetermined position, black stripes or blank areas in a printed image may be less prominent. The configuration as in FIG. 12 is not only effective in the case of arranging the plurality of element substrates 10 in a staggered manner but also in the case of arranging them in a linear (in-line) manner. In other words, even in a case where the plurality of element substrates 10 are arranged in the linear manner, the occurrence of black stripes and blank areas in the printed image corresponding to joining parts (adjacent parts) of the adjacent element substrates 10 can be reduced while suppressing the length of the print head 1 in the conveyance direction of the print medium P to be smaller. In addition, the shape of the element substrate 10 is not limited only to the plane face having the shape of a parallelogram as in this example. The configuration of the present invention can be preferably applied even in the case of using the element substrate 10 having a plane face of, for example, a rectangle, a trapezoid, and other shapes.

9. First and Second Pressure Adjustment Mechanisms

Figure 13A:
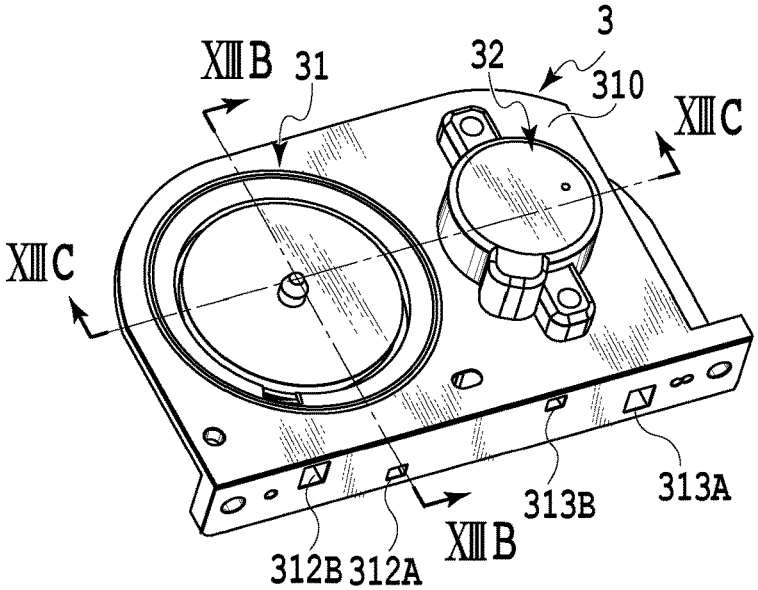
FIGS. 13A, 13B, and 13C are diagrams each illustrating a negative pressure control unit in FIG. 1A.
Figure 13B:
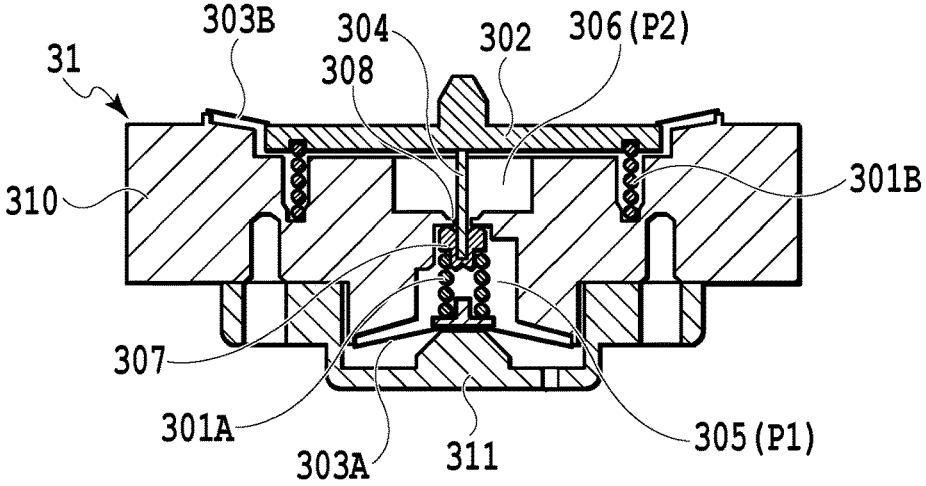
Figure 13C:
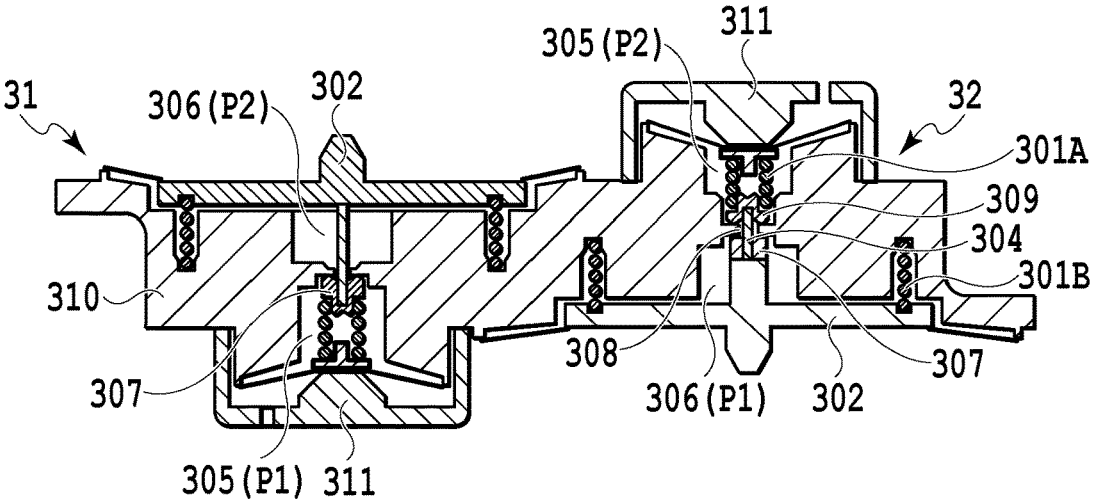

FIGS. 13A, 13B and 13C are diagrams each illustrating the negative pressure control unit 3 including the first pressure control mechanism 31 and the second pressure control mechanism 32. FIG. 13A is a perspective view of the negative pressure control unit 3. FIG. 13B is a cross sectional view taken along line XIIIB-XIIIB of FIG. 13A. FIG. 13C is a cross sectional view taken along line XIIIC-XIIIC of FIG. 13A.

The first pressure control mechanism 31 as a decompression-type regulator mechanism and the second pressure control mechanism 32 as a back-pressure type regulator mechanism are provided in a common body 310, and those mechanisms can be integrally attached and replaced. As shown in FIG. 13C, by arranging the two pressure control mechanisms 31, 32 in a contrasting manner, space saving of the negative pressure control unit 3 can be achieved.

9-1. First Pressure Control Mechanism

The first pressure control mechanism 31 as the decompression-type regulator mechanism includes, as shown in FIG. 13B, a first pressure chamber 305 located at one side of the body 310 (lower side in the figure) and a second pressure chamber 306 located at the other side of the body 310 (upper side in the figure). The first pressure chamber 305 is sealed with a flexible film 303A, and the second pressure chamber 306 is sealed with a pressure receiving plate 302 and a flexible film 303B. Between the first pressure chamber 305 and the second pressure chamber 306, an orifice 308 is formed. Inside the first pressure chamber 305, a valve 307 coupled to the pressure receiving plate 302 via a shaft 304 is located. Upon driving the print head 1, the shaft 304, the valve 307, and the pressure receiving plate 302 integrally move. The pressure receiving plate 302 is urged, by an urging member (spring) 301B, in a direction in which the valve 307 closes the orifice 308. In addition, an urging member (spring) 301A included in the first pressure chamber 305 is urged in the direction in which the valve 307 closes the orifice 308, and the flexible film 303A is urged in a direction of being pushed against the negative pressure adjustment member 311.

The main function of the valve 307 is to change the gap with respect to the orifice 308 and to adjust ink flow resistance. The valve 307 should preferably block the gap with respect to the orifice 308 at the time of ink circulation stop. At the time of the ink circulation stop (at print operation stop), by sealing fluidically between the valve 307 and the orifice 308, negative pressure is continuously applied to the ink in the ejection port 113 so as to prevent ink leakage from the ejection port 113. As a material of the valve 307, an elastic material such as rubber or elastomer having sufficient corrosion resistance against ink may be preferably used.

In this example, two coupled springs are employed as the urging members 301A, 301B. However, since those combined spring forces are only required for obtaining desired negative pressure for ink, a configuration of using only one spring or a configuration of using three or more springs, for example, may also be employed. In the example of FIG. 13B, out of the urging members 301A, 301B (two coupled springs), by providing one urging member 301B to be divided within the second pressure chamber 306, the pressure receiving plate 302 and the shaft 304 are configured to be separated. Even in the state where the pressure receiving plate 302 and the shaft 304 are separated, an urging force of the urging member 301B within the second pressure chamber 306 is applied to the pressure receiving plate 302. Therefore, even in the state where the valve 307 blocks the orifice 308, due to an urging force of the urging member 301B within the second pressure chamber 306, the pressure receiving plate 302 can be separated from the shaft 304 to move in a direction of further increasing the volume within the second pressure chamber 306. As a result, in the state in which the print head 1 is not driven for a long period of time and air bubbles are taken in within the print head 1, the second pressure chamber 306 functions as a buffer to absorb the increased volume of air bubbles, thereby preventing the ink within the print head 1 from becoming a positive pressure.

The first pressure chamber 305 and the second pressure chamber 306 communicate with an ink flow-in port 312A and a flow-out port 312B (see FIG. 13A), respectively. The valve 307 is located in the upstream side of the orifice 308 in an ink-flowing direction, and as the pressure receiving plate 302 moves in an upward direction in FIG. 13B, the gap between the valve 307 and the orifice 308 is reduced. Ink having entered the first pressure chamber 305 from the flow-in port 312A flows in the second pressure chamber 306 through the gap between the valve 307 and the orifice 308, and the pressure of the ink is conveyed to the pressure receiving plate 302. The ink within the second pressure chamber 306 is supplied from the flow-out port 312B to the ink ejection unit 300.

A pressure P2 within the second pressure chamber 306 is determined from a following relational expression (1) showing a balance between forces applied to each of the parts:

$$P2=P0-(P1\times Sv+k1\times x)/Sd \quad (1)$$

Sd represents a pressure-receiving area of the pressure receiving plate 302, Sv represents a pressure-receiving area of the valve 307, P0 represents an atmospheric pressure, P1 represents a pressure within the first pressure chamber 305, and P2 represents a pressure within the second pressure chamber 306. k1 represents a spring constant of urging members 301 (301A, 301B), and x represents displacement (spring displacement) of the urging members 301 (301A, 301B).

Since a second term on the right side of the above expression (1) constantly takes a positive value, P2≤P0 is established and P2 becomes a negative pressure. By changing the urging force of the urging members 301 (301A, 301B), the pressure P2 within the second pressure chamber 306 can be set to a desired control pressure. The urging force of the urging member 301 can be changed in accordance with a spring constant K and the length of the spring during its action.

The following relation of an expression (2) is established between an ink flow resistance R in the gap between the valve 307 and the orifice 308 and an ink flow rate Q passing through the orifice 308:

$$P2=P1-QR \quad (2)$$

Figure 14:
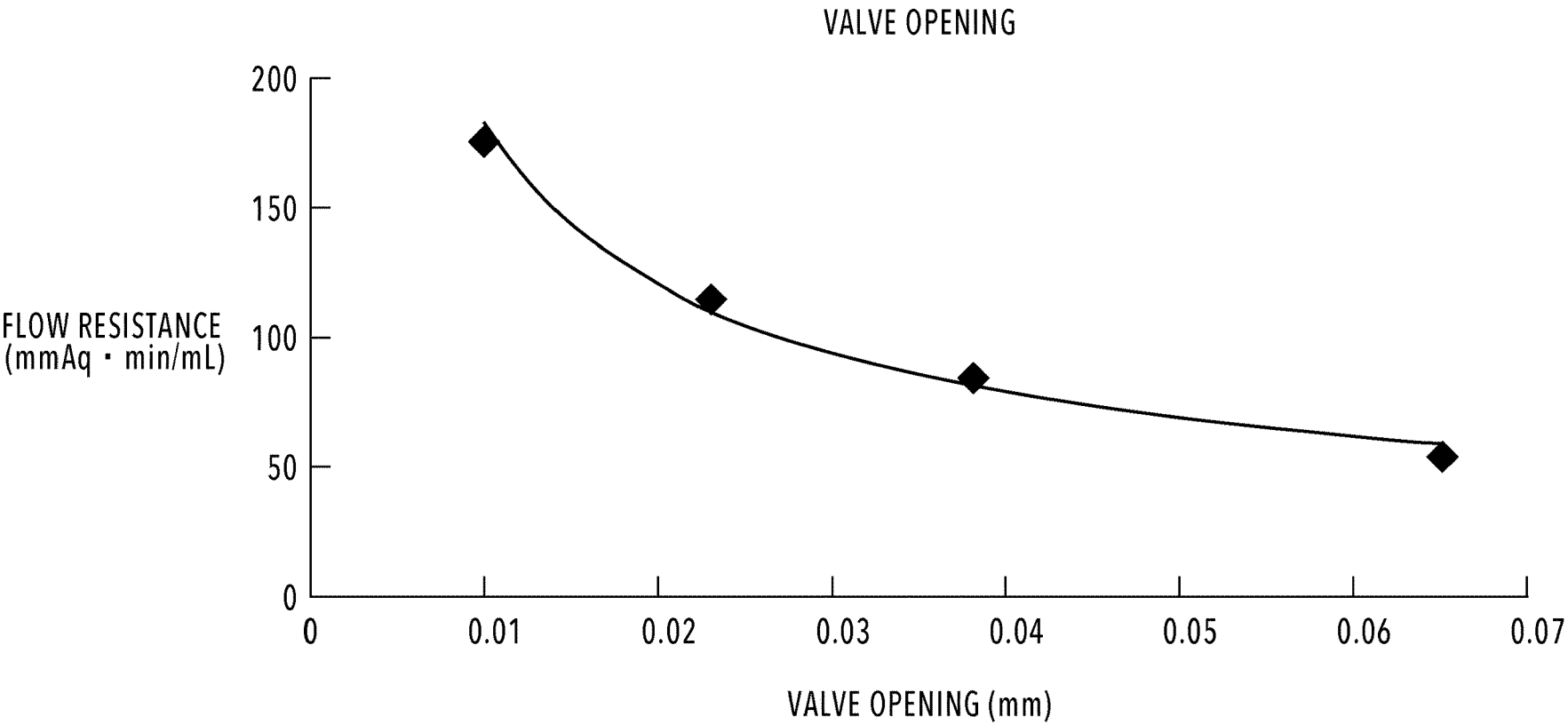
FIG. 14 is a graph illustrating relation between a flow resistance and a valve opening in the negative pressure control unit in FIG. 13A.

A gap between the valve 307 and the orifice 308 (hereinafter referred to as a "valve opening") and a flow resistance R are set to have a relation as shown in FIG. 14, for example, that is, a relation of the flow resistance R being reduced as the valve opening being increased. The valve opening is adjusted such that the expressions (1) and (2) are simultaneously established, and P2 is determined.

In a case where the ink flow rate Q increases, pressure within the tank 20 (see FIG. 2A) is constant, and therefore, due to the increase of the flow rate Q, the flow resistance from the tank 20 to the first pressure control mechanism 31 increases. Therefore, a pressure P1 within the first pressure chamber 305 decreases for the part of increase of the flow resistance. Accordingly, a force (P1×Sv) to block the valve 307 decreases, and as is evident from the expression (1), the pressure P2 within the second pressure chamber 306 instantaneously increases.

Further, an equation, R=(P1−P2)/Q, is derived from the expression (2). The flow rate Q and the pressure P2 increase while the pressure P1 decreases, thereby reducing the flow resistance R. The reduction of the flow resistance R allows increasing the valve opening as illustrated from the relation shown in FIG. 14. Along with the increase of the valve opening, the length of the urging member 301 becomes smaller, thereby increasing a displacement x from the free length. Accordingly, a working force (k1×x) of the urging member 301 becomes large, and as is evident from the expression (1), the pressure P2 within the second pressure chamber 306 instantaneously decreases.

Meanwhile, in the case where the ink flow rate Q flowing into the first pressure control mechanism 31 decreases, the first pressure control mechanism 31 works contrary to the case where the flow rate Q increases. In other words, due to the increase of the pressure P1 within the first pressure chamber 305, the pressure P2 within the second pressure chamber 306 instantaneously decreases, and such decrease of the pressure P2 causes the reduction of the flow resistance R, whereby the pressure P2 within the second pressure chamber 306 results in an instantaneous increase.

As the instantaneous increase and decrease of the pressure P2 are repeated and the valve opening changes in accordance with the flow rate Q, both the expressions (1) and (2) are established, whereby the pressure P2 within the second pressure chamber 306 is consequently controlled to be constant. Therefore, pressure in the downstream side of the first pressure control mechanism 31 (common supply flow path 12 side) is autonomously controlled to be constant.

Furthermore, the negative pressure adjustment member 311 fixed to the body 310 is to change an accommodating length and an urging force of the urging member 301A within the first pressure chamber 305. At the position of the negative pressure adjustment member 311 opposing the first pressure chamber 305, a protrusion is provided. By selectively fixing, to the body 310, one of the negative pressure adjustment members 311 having different heights of protrusions, an urging force of the urging member 301A can be changed so as to change or adjust the control pressure of the first pressure control mechanism 31. Accordingly, even in a case where a water head difference between the negative pressure control unit 3 and the formation face of the ejection port of the print head 1 differs, the negative pressure adjustment member 311 can be replaced with the one having a protrusion of a different height while employing the same first pressure control mechanism 31.

9-2. Second Pressure Control Mechanism

The second pressure control mechanism 32 as the back-pressure type regulator mechanism is configured to be identical to the above-described first pressure control mechanism 31 except the following differences. Therefore, the same reference numerals will be given for components identical to those of the first pressure control mechanism 31, and their explanations will be omitted.

One of those differences is that the valve 307 of the second pressure control mechanism 32 is disposed within the second pressure chamber 306. Another difference is that, in the case where the pressure receiving plate 302 of the second pressure control mechanism 32 moves in an urging direction (downward in FIG. 13B) of the urging member 301B, a gap between the valve 307 and the orifice 308 (valve opening) is enlarged. Still another difference is that the second pressure chamber 306 of the second pressure control mechanism 32 communicates with an ink flow-in port 313A (see FIG. 13A), and the first pressure chamber 305 of the second pressure control mechanism 32 communicates with an ink flow-out port 313B (see FIG. 13A). Therefore, in the second pressure control mechanism 32, as is contrary to the first pressure control mechanism 31, ink flows from the second pressure chamber 306 toward the first pressure chamber 305. Further another difference is that the valve 307 of the second pressure control mechanism 32 is integrated with the pressure receiving plate 302 via the shaft 304. Furthermore, the shaft 304 of the second pressure control mechanism 32 abuts on a shaft holder 309 penetrating the orifice 308. The valve 307 and the pressure receiving plate 302 are integrated via the shaft 304, and thus, receive not only the urging force of the urging member 301A within the first pressure chamber 305 but also the urging force of the urging member 301B within the second pressure chamber 306.

A mechanism of pressure adjustment in the second pressure control mechanism 32 is identical to the above-described first pressure control mechanism 31, and a pressure P1 within the second pressure chamber 306 in the upstream side is determined by the following relational expression (3) showing a balance between forces applied to each of the parts:

$$P1=P0-(P2\times Sv+k1\times x)/Sd \quad (3)$$

Sd represents a pressure-receiving area of the pressure receiving plate 302, Sv represents a pressure-receiving area of the valve 307, P0 represents an atmospheric pressure, P1 represents a pressure within the second pressure chamber 306 in the upstream side, and P2 represents a pressure within the first pressure chamber 305 in the downstream side. k1 represents a spring constant of urging members 301 (301A, 301B) and x represents displacement (spring displacement) of the urging members 301 (301A, 301B). Since a second term on the right side of the above expression (3) constantly takes a positive value, P1≤P0 is established and P1 becomes a negative pressure. Further, the following relation of an expression (4) is established between the ink flow resistance R in the gap between the valve 307 and the orifice 308 and the ink flow rate Q passing through the orifice 308:

$$P1=P2-QR \quad (4)$$

The gap between the valve 307 and the orifice 308 (valve opening) and the flow resistance R are set to have a relation as shown in FIG. 14, that is, a relation of the flow resistance R being reduced as the valve opening being increased. The valve opening is adjusted so that the expressions (3) and (4) are simultaneously established, and a pressure P1 within the second pressure chamber 306 in the upstream side is determined.

In the case where the ink flow rate Q increases, since the pressure of the suction pump 1000 (see FIG. 3A) to be connected to the downstream side of the negative pressure control unit 3 is constant, the flow resistance from the second pressure control mechanism 32 to the suction pump 1000 increases due to the increase of the flow rate Q. Therefore, a pressure P2 within the first pressure chamber 305 increases for the part of the increase of the flow resistance. Accordingly, a force (P2×Sv) to block the valve 307 increases, and as is evident from the expression (3), the pressure P1 within the second pressure chamber 306 in the upstream side instantaneously decreases.

Further, an equation, R=(P1−P2)/Q, is derived from the expression (4). The flow rate Q and the pressure P2 increase while the pressure P1 decreases, thereby reducing the flow resistance R. The reduction of the flow resistance R allows increasing the valve opening as illustrated from the relation shown in FIG. 14. Along with the increase of the valve opening, the length of the urging member 301 becomes larger, thereby decreasing a displacement x from the free length. Accordingly, a working force (k1×x) of the urging member 301 becomes small, and as is evident from the expression (3), the pressure P1 within the second pressure chamber 306 in the upstream side instantaneously increases.

Meanwhile, in the case where the ink flow rate Q decreases, the second pressure control mechanism 32 works contrary to the case where the flow rate Q increases. In other words, due to the decrease of the pressure P2 within the first pressure chamber 305 in the downstream side, the pressure P1 within the second pressure chamber 306 in the upstream side instantaneously increases, and such increase of the pressure P1 causes the increase of the flow resistance R, whereby the pressure P1 within the second pressure chamber 306 in the downstream side results in an instantaneous decrease.

As the instantaneous increase and decrease of the pressure P1 within the second pressure chamber 306 in the upstream side are repeated and the valve opening changes in accordance with the flow rate Q, both the expressions (3) and (4) are established, whereby the pressure P1 within the second pressure chamber 306 in the upstream side is controlled to be constant. Therefore, pressure in the upstream side of the second pressure control mechanism 32 (common collection flow path 13 side) is autonomously controlled to be constant.

Further, an accommodating length and an urging force of the urging member 301A within the first pressure chamber 306 can be changed by the negative pressure adjustment member 311 of the second pressure control mechanism 32, as in the negative pressure adjustment member 311 in the first pressure control mechanism 31. Therefore, the same negative pressure control unit 3 may be used for various printing apparatuses having different use conditions to achieve cost reduction.

Second Embodiment

Figure 15B:
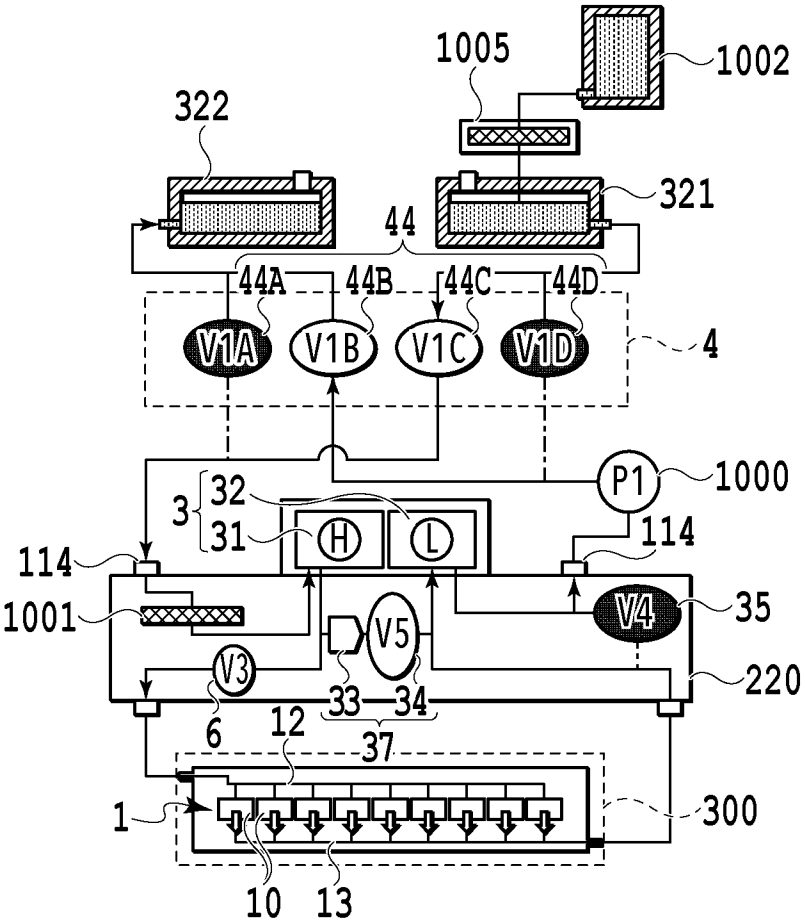
FIGS. 15A and 15B are diagrams illustrating an ink flow path in different states in a printing apparatus of a second embodiment of the present invention.
Figure 15A:
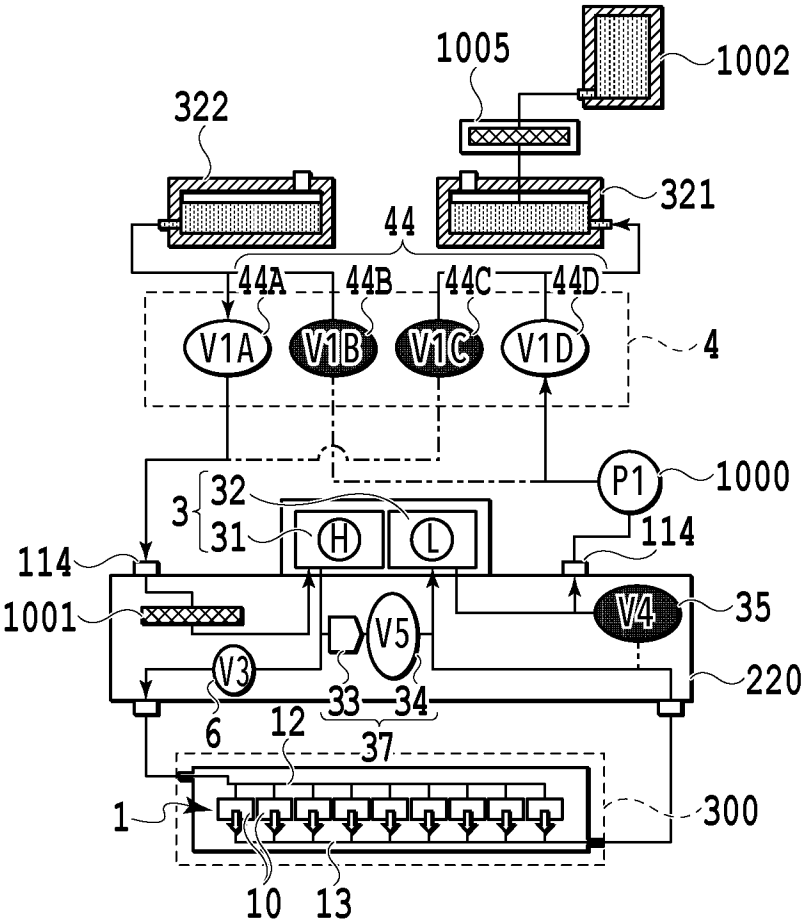

FIGS. 15A and 15B are diagrams illustrating a second embodiment of the present invention. The same reference numerals will be given for components identical to those of the first embodiment, and their explanations will be omitted.

In the present embodiment, to the ink supply unit 220 and the negative pressure control unit 3 which are identical to those in the first embodiment, a first tank 321 and a second tank 322 which can accommodate ink are connected via a switching mechanism 4. The first tank 321 is connected to a main tank 1002 via a filter 1005, which can be replenished with ink from the main tank 1002. The switching mechanism 4 includes four opening/closing valves 44 (44A, 44B, 44C, 44D), and switches a connection relation between the first and second pressure control mechanisms 31, 32 within the negative pressure control unit 3 and between the first and second tanks 321, 322. The opening/closing valves 44A, 44B are connected to the first tank 321, and the opening/closing valves 44C, 44D are connected to the second tank 322. Hereinafter, the opening/closing valves 44A, 44C connected to the upstream side of the first pressure control mechanism 31 are also referred to as a first switching part, and the opening/closing valves 44B, 44D connected to the downstream side of the second pressure control mechanism 32 are also referred to as a second switching part.

FIG. 15A shows a state in which the opening/closing valves 44A, 44D are open and the opening/closing valves 44B, 44C are closed, and shows that a portion upstream of the first pressure control mechanism 31 is connected to the second tank 322 side and the second pressure control mechanism 32 is connected to the first tank 321 side. On the contrary, FIG. 15B shows a state in which the opening/closing valves 44A, 44D are closed and the opening/closing valves 44B, 44C are open, and shows that the first pressure control mechanism 31 is connected to the first tank 321 side, and the second pressure control mechanism 32 is connected to the second tank 322 side. As such, by the use of the first switching part (opening/closing valves 44A, 44C) and the second switching part (opening/closing valves 44B, 44D), the connection relation between the first and second pressure control mechanisms 31, 32 and between the first and second tanks 321, 322 can be mutually switched. Due to this, an ink-flowing direction for the first and second tanks 321, 322 can be switched. In a case where pigment ink, for example, which mostly includes a solid component is used, the switching of the ink-flowing direction allows suppressing precipitation of the pigment component within the tank to carry out stable print operation.

The switching control of the switching mechanism 4 is performed by the control unit in the printing apparatus body side based on a signal from a detecting mechanism (not shown) which detects an ink remaining amount within the first and second tanks 321, 322. The switching mechanism 4 should at least have a function of switching the connection states as described above. Accordingly, the switching mechanism 4 is not limited only to the form that simply combines the four opening/closing valves as in this example, but may have a form constituting first and second switching parts by using, for example, a three-way valve, a slide valve, or a rotary valve.

Furthermore, the negative pressure compensation mechanism 37 is also included in the present embodiment. Therefore, as in the above-described first embodiment, even in a case where a large amount of ink is ejected from the ejection ports 113 of the element substrates 10 in a short period of time, excessive decline of negative pressure in the common collection flow path 13 can be suppressed to carry out stable print operation. In addition, since the bypass valve 35 is provided, the enhanced recovery mode (enhanced circulation recovery) can be implemented.

Third Embodiment

Figure 16B:
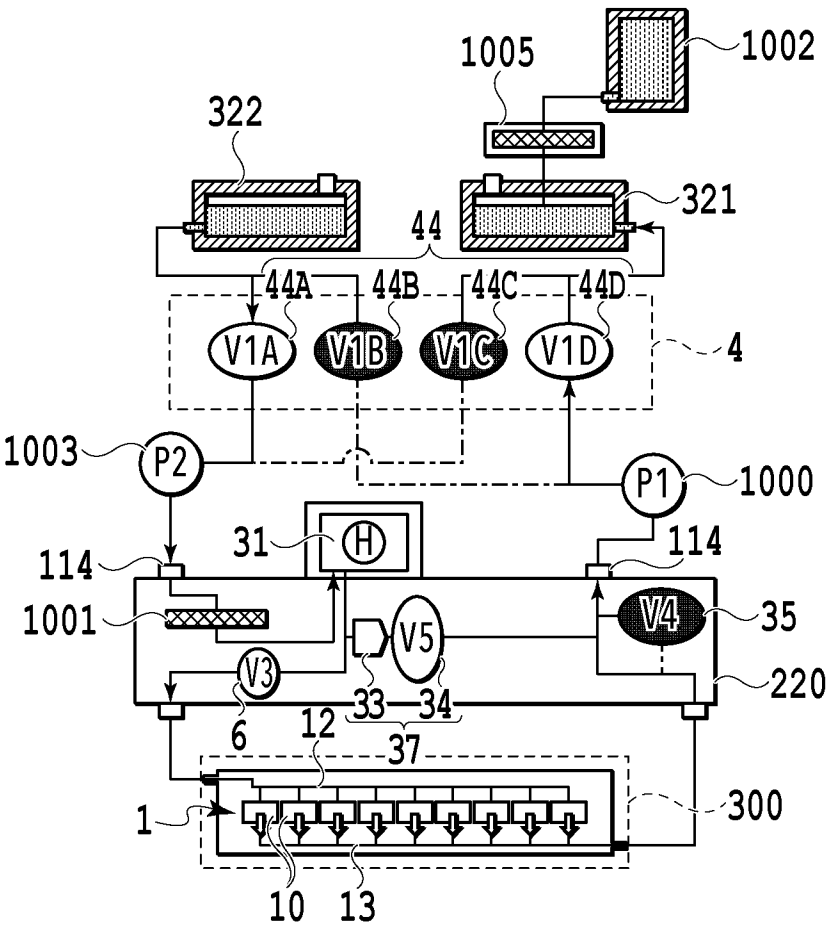
FIGS. 16A and 16B are diagrams illustrating an ink flow path in different states in a printing apparatus of a third embodiment of the present invention.
Figure 16A:
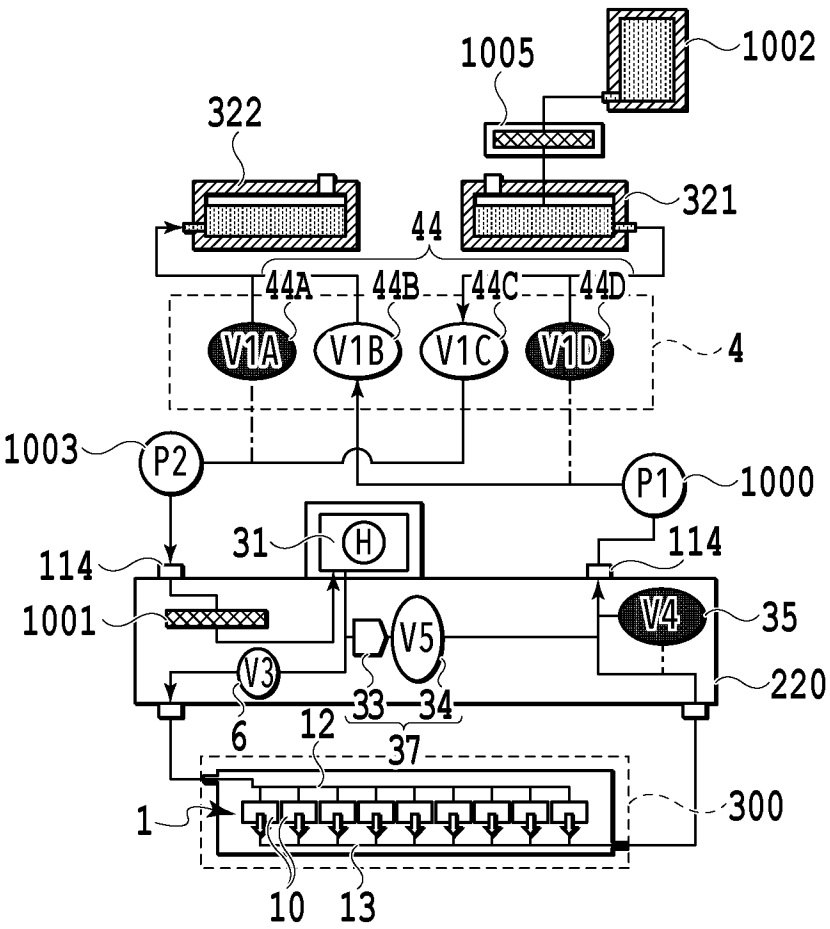

FIGS. 16A and 16B are diagrams illustrating a third embodiment of the present invention. The same reference numerals will be given for components identical to those of the second embodiment, and their explanations will be omitted. A primary difference from the second embodiment is that the pressurizing pump 1003 and the suction pump 1000 are used for the generation of an ink flow instead of using the second pressure adjustment mechanism in the second embodiment.

FIG. 16A shows a state in which the opening/closing valves 44A, 44D are open and the opening/closing valves 44B, 44C are closed. In this state, ink in the second tank 322 is drawn by the pressurizing pump 1003 and ink is fed to the first tank 321 side by the suction pump 1000. On the contrary, FIG. 16B shows a state in which the opening/closing valves 44A, 44D are closed and the opening/closing valves 44B, 44C are open. In this state, ink in the first tank 321 is drawn by the pressurizing pump 1003 and the ink is fed to the second tank 322 side by the suction pump 1000. Therefore, in the case where the ink-flowing direction is switched as in the second embodiment and pigment ink, for example, which mostly includes a solid component is used, precipitation of the pigment component within the tank can be suppressed to carry out stable print operation. An effect produced by the negative pressure compensation mechanism 37 and the bypass valve 35 is identical to those of the first and second embodiments.

Fourth Embodiment

Figure 17B:
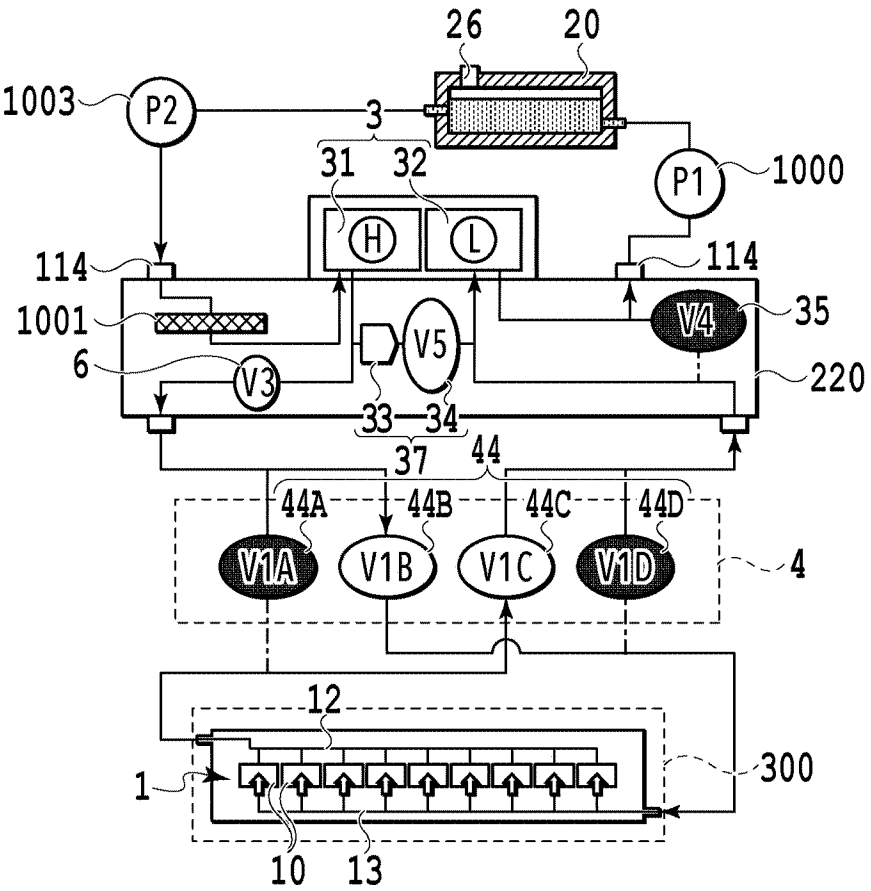
FIGS. 17A and 17B are diagrams illustrating an ink flow path in different states in a printing apparatus of a fourth embodiment of the present invention.
Figure 17A:
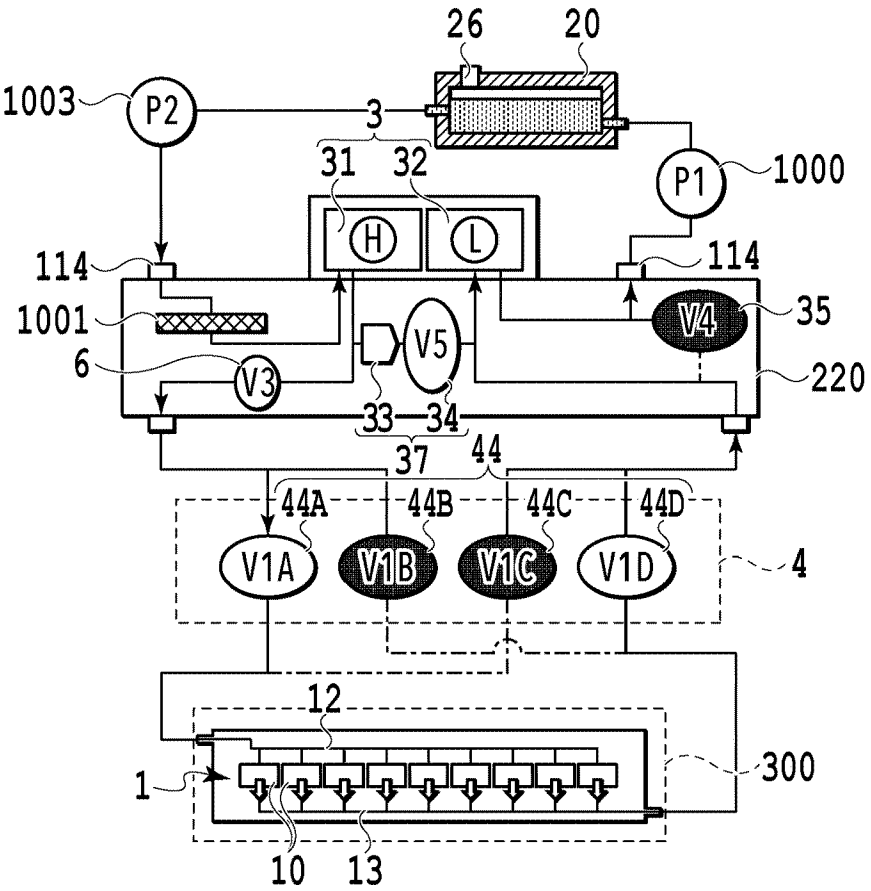

FIGS. 17A and 17B are diagrams illustrating a fourth embodiment of the present invention. The same reference numerals will be given for components identical to those of the above-described first and second embodiments, and their explanations will be omitted. In the present embodiment, between the ink supply unit 220 and the ink ejection unit 300 in the first embodiment, the switching mechanism 4 of the second embodiment is provided. In the switching mechanism 4, the opening/closing valves 44A, 44B are connected to the downstream side of the first pressure control mechanism 31 and the opening/closing valves 44C, 44D are connected to the upstream side of the second pressure control mechanism 32.

FIG. 17A shows a state in which the opening/closing valves 44A, 44D are open and the opening/closing valves 44B, 44C are closed, and shows that the first pressure control mechanism 31 is connected to the common supply flow path 12 and the second pressure control mechanism 32 is connected to the common collection flow path 13. On the contrary, FIG. 17B shows a state in which the opening/closing valves 44A, 44D are closed and the opening/closing valves 44B, 44C are open, and shows that the first pressure control mechanism 31 is connected to the common collection flow path 13 and the second pressure control mechanism 32 is connected to the common supply flow path 12. As such, by opening or closing the opening/closing valves 44 (44A, 44B, 44C, 44D), the connection relation between the first and second pressure control mechanisms 31, 32 and between the common supply flow path 12 and common collection flow path 13 can be switched. Accordingly, ink-flowing directions within the ink ejection unit 300 including the element substrates 10 can be switched.

As such, since the ink-flowing direction can be reversed within the ink ejection unit 300, in the above-described enhanced recovery mode, foreign matters such as bubbles in the common supply flow path 12 side can also be discharged. Typically, a flow path in the vicinity of the ejection port 113 is the finest flow path within the print head 1. Accordingly, it is difficult to discharge foreign matters or the like such as bubbles resided in the upstream side of the ejection port 113 from the downstream side of the ejection port 113 passing by the ejection port in spite of increasing the ink flow rate. In the above-described first to third embodiments, an ink-flowing direction within the print head 1 is limited to one direction, and therefore, it is difficult to discharge foreign matters such as bubbles in the common supply flow path 12 side to the common collection flow path 13 side. In order to remove such foreign matters, a recovery method such as suction recovery processing which suctions ink from the ejection port will be required. However, the use of such a recovery method results in generating waste ink that is not used for printing an image.

In the present embodiment, after performing the enhanced recovery mode for a predetermined period of time, an ink-flowing direction in the print head 1 is reversed by the switching mechanism 4 and then the enhanced recovery mode is carried out again, whereby the foreign matters such as bubbles in the print head 1 can be discharged to the tank 20. As a result, more reliable print operation can be carried out while significantly reducing the amount of waste ink. In addition, as in the first embodiment, the negative pressure compensation mechanism 37 is provided. Therefore, even in a case where a large amount of ink is ejected from the ejection ports 113 of the element substrates 10 in a short period of time, excessive decline of the negative pressure in the common collection flow path 13 can be suppressed to carry out the stable print operation.

Fifth Embodiment

Figure 18B:
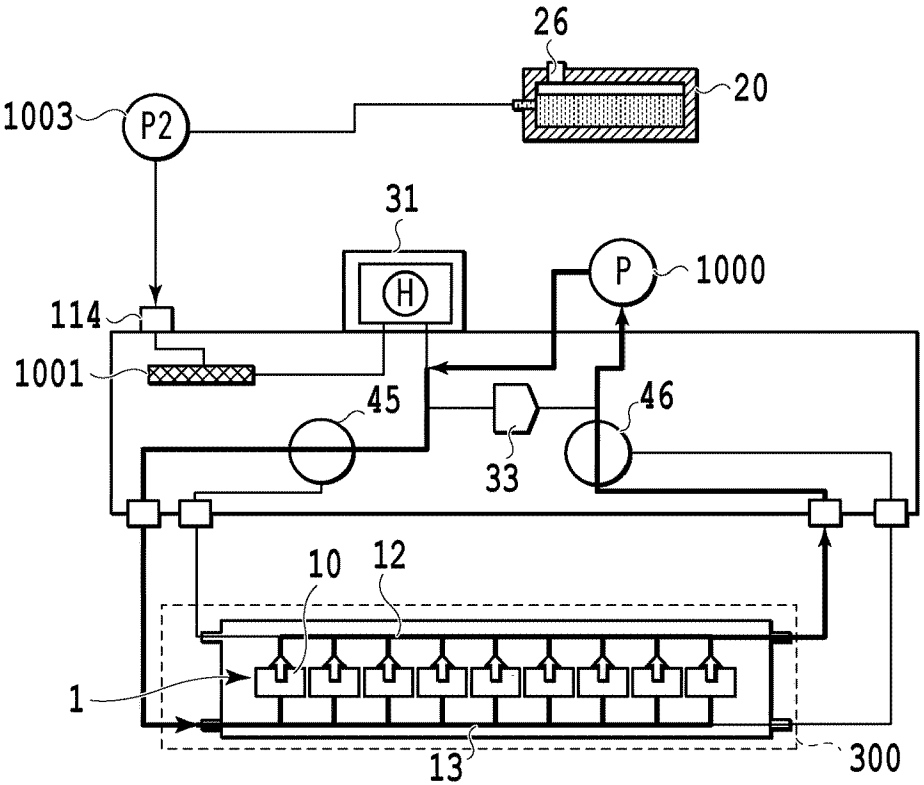
FIGS. 18A and 18B are diagrams illustrating an ink flow path in different states in a printing apparatus of a fifth embodiment of the present invention.
Figure 18A:
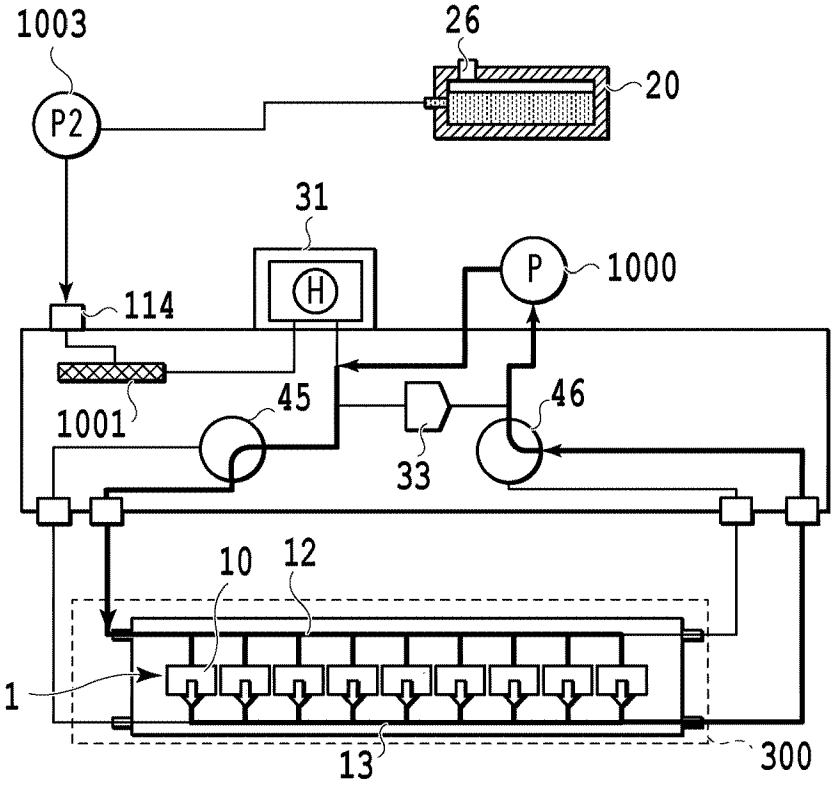

FIGS. 18A and 18B are diagrams illustrating a fifth embodiment of the present invention. The same reference numerals will be given for components identical to those of the above-described first embodiment, and their explanations will be omitted.

FIGS. 18A and 18B are schematic views illustrating an ink flow path (for single color) in a printing apparatus of the present embodiment. Major differences from the first embodiment are that there is no second pressure control mechanism (L) 32 and that the downstream side of the pump 1000 is not where the main tank 20 is located but the pump 1000 is connected to the downstream side of the first pressure control mechanism (H) 31. Further, a three-way valve 45 is disposed between the first pressure control mechanism 31 and the ink ejection unit 300, and a three-way valve 46 is disposed between the ink ejection unit 300 and the pump 1000. The three-way valve 45 is configured such that its connection target in the downstream side of the first pressure control mechanism 31 is switched to either the common supply flow path 12 or the common collection flow path 13. The three-way valve 46 is configured such that its connection target in the upstream side of the pump 1000 is switched to either the common supply flow path 12 or the common collection flow path 13.

FIG. 18A shows a circulating state in which ink within the print element substrate 10 flows from the common supply flow path 12 toward the common collection flow path 13. The states of the flow paths within the three-way valves 45 and 46 are switched as shown with lines in circle marks in the figure illustrating those valves. By driving the pump 1000, ink flows from the three-way valve 45 to the common supply flow path 12, the print element substrate 10, the common collection flow path 13, and the three-way valve 46, and then returns to the pump 1000 for circulation. Due to print operation, ink is ejected from the nozzle of the print element substrate 10, and the ink that has been decreased is supplemented via the main tank 20, the pressurizing pump 1003, the filter 1001, and the first pressure control mechanism 31. Ink pressure in the upstream side of the ink ejection unit 300 is controlled by the first pressure control mechanism 31 to be in an appropriate negative pressure for ink ejection operation. Here, let us assume that only a specific color of ink is used for printing in a monochrome mode or the like and ink ejection operation has not been made during ink flow shown in FIG. 18A. In this case, even if only ink circulation is made by the pump 1000, the pressure in the downstream side of the pump 1000 is maintained to a predetermined pressure by the first pressure control mechanism 31.

Further, the passive valve 33 capable of compensating negative pressure is provided as in the first embodiment. Accordingly, even in a case where the large amount of ink is ejected in a short period of time from the ejection port 113 of the print element substrate 10, the excessive decline of negative pressure in the common collection flow path 13 can be suppressed to carry out stable print operation.

FIG. 18B shows a state of circulating ink, by switching the three-way valves 45 and 46, so that the ink within the print element substrate 10 flows from the common supply flow path 12 toward the common collection flow path 13. The states of the flow paths within the three-way valves 45 and 46 are switched as shown with lines in circle marks in the figure illustrating those valves.

As such, since the ink-flowing direction can be reversed within the ink ejection unit 300, bubbles and foreign matters in the common supply flow path 12 side can also be discharged. Further, in the present embodiment, an ink supply route from the main tank 20 only needs one for each color and no second pressure control mechanism is present, and thus, the structure of the printing apparatus can be simplified and downsized.

Sixth Embodiment

Figure 19B:
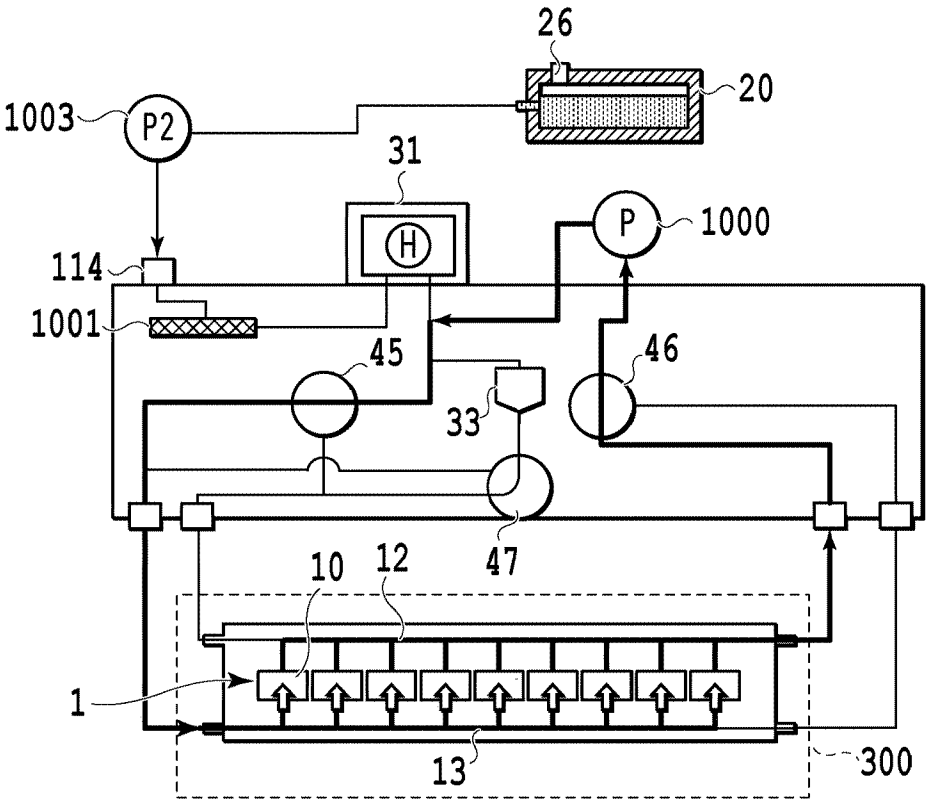
FIGS. 19A and 19B are diagrams illustrating an ink flow path in different states in a printing apparatus of a sixth embodiment of the present invention.
Figure 19A:
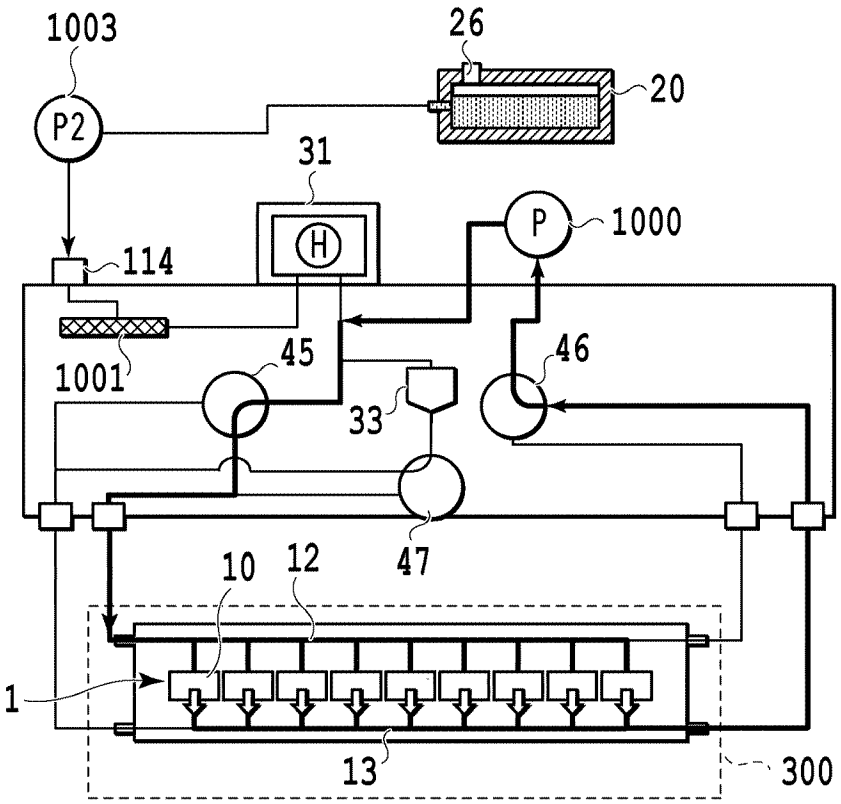

FIGS. 19A and 19B are diagrams illustrating a sixth embodiment of the present invention. The same reference numerals will be given for components identical to those of the above-described fifth embodiment, and their explanations will be omitted.

FIGS. 19A and 19B are schematic views illustrating an ink flow path (for single color) in a printing apparatus of the present embodiment. A difference from the fifth embodiment is that a three-way valve 47 is added to the downstream side of the passive valve 33 that provides a negative pressure compensation function. The three-way valve 47 is configured such that its connection target in its downstream side is switched to either the upstream side of the common supply flow path 12 or the upstream end of the common collection flow path 13.

FIG. 19A shows a circulating state in which ink within the print element substrate 10 flows from the common supply flow path 12 toward the common collection flow path 13. At this time, the state of the flow path within the three-way valve 47 is switched as shown with a line in a circle mark in the figure illustrating the valve, and the downstream side of the three-way valve 47 is connected to the upstream end of the common collection flow path 13. In a case where the high-duty printing is performed in this state, ink is also supplied into the print element substrate 10 from the common collection flow path 13 side. In such a case, the passive valve 33 opens and ink is supplied from the upstream side of the common collection flow path 13 so as to prevent the negative pressure within the common collection flow path 13 from rising too high. In the above fifth embodiment shown in FIG. 18A as well, the negative pressure compensation function is served by the passive valve 33 at the time of high-duty printing, ink is supplied from the downstream side of the common collection flow path 13. Accordingly, due to an inertial influence caused by reversing ink flow at the time of abrupt change in printing duty, transient pressure variation may possibly occur. Particularly, this influence becomes larger for an elongate line head of a high ink flow rate. In contrast, according to the sixth embodiment, ink is constantly supplied from the upstream side of the common collection flow path 13 so as to ensure a stable pressure at the time of any printing operation.

FIG. 19B shows a state of circulating ink, by switching the three-way valves 45 and 46, so that the ink within the print element substrate 10 flows from the common supply flow path 12 toward the common collection flow path 13 and that bubbles and foreign matters in the common supply flow path 12 side are discharged. At this time, the three-way valve 47 is switched so as to connect its downstream side to the upstream side of the common supply flow path 12. The state of the flow path within the three-way valve 47 is switched as shown with the line in the circle mark in the figure illustrating the valve. In a case where the high-duty printing is performed in this state, the passive valve 33 opens and ink is supplied from the upstream side of the common supply flow path 12. Therefore, as similar to FIG. 19A, a stable pressure can be ensured.

Other Embodiments

The print head 1 may be applicable as long as it can eject ink within the pressure chamber 123 from the ejection port 113 by using the ejection energy generation element such as the heater 115. Therefore, as in FIG. 2A, the print head 1 is not limited only to the configuration including the ink ejection unit 300, the ink supply unit 220, and the ink circulation unit 400. For instance, the print head 1 may have a configuration having an ink ejection module (liquid ejection module) including at least one of the ink ejection unit 300, the ink supply unit 220, and the ink circulation unit 400. Further, a method of the printing apparatus is not limited to the full-line type as in the above embodiments, but may also be the so-called serial scanning type which prints an image by repeating the movement of the print head in a main-scanning direction and the conveyance of the print medium in a sub-scanning direction.

The present invention can be widely applied to a liquid supply apparatus that supplies various types of liquid and a liquid ejection apparatus that can eject various types of liquid. In addition, the present invention can also be applied to an inkjet apparatus that performs various types of processing (such as printing, machining, coating, irradiation, scanning, and detection) on various media (sheets) using an inkjet head that can eject liquid. The media (including print media) include various types of media to which liquid including ink is applied irrespective of materials such as paper, plastic, film, fabric, metal, and flexible substrate.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2017-188773, filed Sep. 28, 2017 and No. 2018-171902 filed Sep. 13, 2018 which are hereby incorporated by reference wherein in their entirety.

What is claimed is:

1. A liquid supply apparatus which supplies liquid to a pressure chamber that holds liquid ejected from an ejection port, the apparatus comprising:

a supply flow path for liquid which communicates with the pressure chamber;

a collection flow path for liquid which communicates with the pressure chamber;

a pressure control unit configured to generate a pressure difference between the supply flow path and the collection flow path so as to supply liquid from the supply flow path to the pressure chamber and to collect liquid from the pressure chamber to the collection flow path; and a pressure compensation unit configured to compensate for reduction of pressure in the collection flow path by supplying liquid to the collection flow path in a case where pressure in the collection flow path is a predetermined pressure or lower, wherein the pressure control unit includes:

a first pressure control section configured to control pressure within the supply flow path to be a first pressure; and a second pressure control section to control pressure within the collection flow path to be a second pressure that is lower than the first pressure and the liquid supply apparatus further comprises a suction pump which is provided at a position in a downstream side of the second pressure control section in the collection flow path in a liquid collecting direction.

2. The liquid supply apparatus according to claim 1, wherein the supply flow path and the collection flow path communicate with each of a plurality of the pressure chambers.

3. The liquid supply apparatus according to claim 1, wherein the pressure compensation unit includes a communication path which causes the supply flow path and the collection flow path to communicate with each other in a case where pressure within the collection flow path is a predetermined pressure or lower.

4. The liquid supply apparatus according to claim 3, wherein the pressure compensation unit includes a passive valve which opens or closes the communication path in accordance with a differential pressure between a pressure within the supply flow path and a pressure within the collection flow path.

5. The liquid supply apparatus according to claim 3, further comprising an opening/closing valve in the communication path, the opening/closing valve being controlled to be open and close.

6. The liquid supply apparatus according to claim 1, further comprising a bypass flow path which is provided between a position upstream of the second pressure control section in the collection flow path in a liquid collecting direction and a position downstream of the second pressure control section in the collection flow path in the collecting direction.

7. The liquid supply apparatus according to claim 6, further comprising a bypass valve provided in the bypass flow path, the bypass valve being controlled to be open and close.

8. The liquid supply apparatus according to claim 1, further comprising:

a first tank and a second tank configured to accommodate liquid; and a switching unit configured to switch between (i) a first form in which a first position upstream of the first pressure control section in the supply flow path in a liquid supplying direction is connected to the first tank and a second position downstream of the second pressure control section in the collection flow path in a liquid collecting direction is connected to the second tank and (ii) a second form in which the first position is connected to the second tank and the second position is connected to the first tank.

9. The liquid supply apparatus according to claim 1, further comprising a switching unit configured to switch between (i) a first form in which a third position in a downstream side of the first pressure control section in the supply flow path in a liquid supplying direction is connected to one side of the pressure chamber and a fourth position in an upstream side of the second pressure control section in the collection flow path in a liquid collecting direction is connected to the other side of the pressure chamber and (ii) a second form in which the third position is connected to the other side of the pressure chamber and the fourth position is connected to the one side of the pressure chamber.

10. A liquid supply apparatus which supplies liquid to a pressure chamber that holds liquid ejected from an ejection port, the apparatus comprising:

a supply flow path for liquid which communicates with the pressure chamber;

a collection flow path for liquid which communicates with the pressure chamber;

a pressure control unit configured to generate a pressure difference between the supply flow path and the collection flow path so as to supply liquid from the supply flow path to the pressure chamber and to collect liquid from the pressure chamber to the collection flow path; and a pressure compensation unit configured to compensate for reduction of pressure in the collection flow path by supplying liquid to the collection flow path in a case where pressure in the collection flow path is a predetermined pressure or lower, wherein the pressure control unit comprises:

a first pressure control section provided in a upstream side in the supply flow path in a liquid supplying direction for controlling a pressure within the supply flow path; and a pump in which an inlet is connected to a downstream side in the collection flow path in a liquid collecting direction and an outlet is connected to a downstream side of the pressure control unit in the supply flow path in a liquid supplying direction.

11. A liquid supply apparatus which supplies liquid to a pressure chamber that holds liquid ejected from an ejection port, the apparatus comprising:

a supply flow path for liquid which communicates with the pressure chamber;

a collection flow path for liquid which communicates with the pressure chamber;

a pressure control unit configured to generate a pressure difference between the supply flow path and the collection flow path so as to supply liquid from the supply flow path to the pressure chamber and to collect liquid from the pressure chamber to the collection flow path;

a pressure compensation unit configured to compensate for reduction of pressure in the collection flow path by supplying liquid to the collection flow path in a case where pressure in the collection flow path is a predetermined pressure or lower; and a switching unit configured to switch between;

a first form in which a high pressure side of a pressure difference caused by the pressure control unit is connected to the supply flow path and a low pressure side of the pressure difference is connected to the collection flow path; and a second form in which the high pressure side is connected to the collection flow path and the low pressure side is connected to the supply flow path.

12. The liquid supply apparatus according to claim 11, wherein the pressure compensation unit comprises a switching unit for switching a communication path so as to connect, in the first form, the high pressure side of the pressure difference caused by the pressure control unit to the collection flow path via a passive valve, and so as to connect, in the second form, the high pressure side to the supply flow path via the passive valve; and the passive valve, in the first form, opens in a case where a pressure within the collection flow path is a predetermined pressure or lower, and, in the second form, opens in a case where a pressure within the supply flow path is the predetermined pressure or lower.

* * * * *